US006007194A

United States Patent [19]

Yokoyama et al.

[11] Patent Number: 6,007,194

[45] Date of Patent: Dec. 28, 1999

[54] INK JET PRINTING METHOD FOR FEEDING AND EJECTING A SHEET TO PREVENT A SHEET FROM ADHERING TO A SUCCESSIVE SHEET

[75] Inventors: Kouichirou Yokoyama; Toshikazu Kotaka; Masaki Shimomura; Kazutoshi Kashiwabara; Takuya Yasue, all of Nagano, Japan

[73] Assignee: Seiko Epson Corporation, Tokyo, Japan

[21] Appl. No.: 08/715,984

[22] Filed: Sep. 19, 1996

[30] Foreign Application Priority Data

Sep. 19, 1995 [JP] Japan ..... 7-264876

[51] Int. Cl.[6] ..... B41J 2/01

[52] U.S. Cl. ..... 347/104

[58] Field of Search ..... 342/101, 104, 342/105, 106; 101/426; 347/104, 105, 8; 400/582; 355/407, 408; 271/265.1, 258.1

[56] References Cited

U.S. PATENT DOCUMENTS

| | | | |
|---|---|---|---|
| 4,469,026 | 9/1984 | Irwin | 101/426 |
| 5,495,326 | 2/1996 | Mikida | 355/309 |
| 5,646,668 | 7/1997 | Fujiok et al. | 347/104 |

FOREIGN PATENT DOCUMENTS

| | | | |
|---|---|---|---|
| 556045-A2 | 8/1993 | European Pat. Off. | 347/104 |
| 2-245356 | 3/1989 | Japan . | |
| 2-29340 | 1/1990 | Japan | 347/102 |
| 2-245356 | 10/1990 | Japan . | |
| 2-303842 | 12/1990 | Japan . | |
| 3-159746 | 7/1991 | Japan . | |
| 3-234624 | 10/1991 | Japan | 347/102 |
| 7-035579 | 2/1995 | Japan . | |
| 7-205416 | 8/1995 | Japan . | |

*Primary Examiner*—N. Le
*Assistant Examiner*—Thien Tran
*Attorney, Agent, or Firm*—Stroock & Stroock & Lavan LLP

[57] ABSTRACT

An ink jet recording method ejecting already printed sheets stacked one on top of another, wherein: a period T, necessary for ink printed on a former sheet to be fixed enough that it does not adhere to a successive sheet stacked on top of the former sheet is set; an elapsed period tn is measured from a point in time when printing of the former sheet is completed; the elapsed period is compared with a set period when the successive sheet is ejected; and if the elapsed period has not reached the set period, the successive sheet is ejected by an intermittent feeding operation in which the successive sheet slidingly contacts the former sheet at a point in time when the elapsed period exceeds the set period.

36 Claims, 11 Drawing Sheets

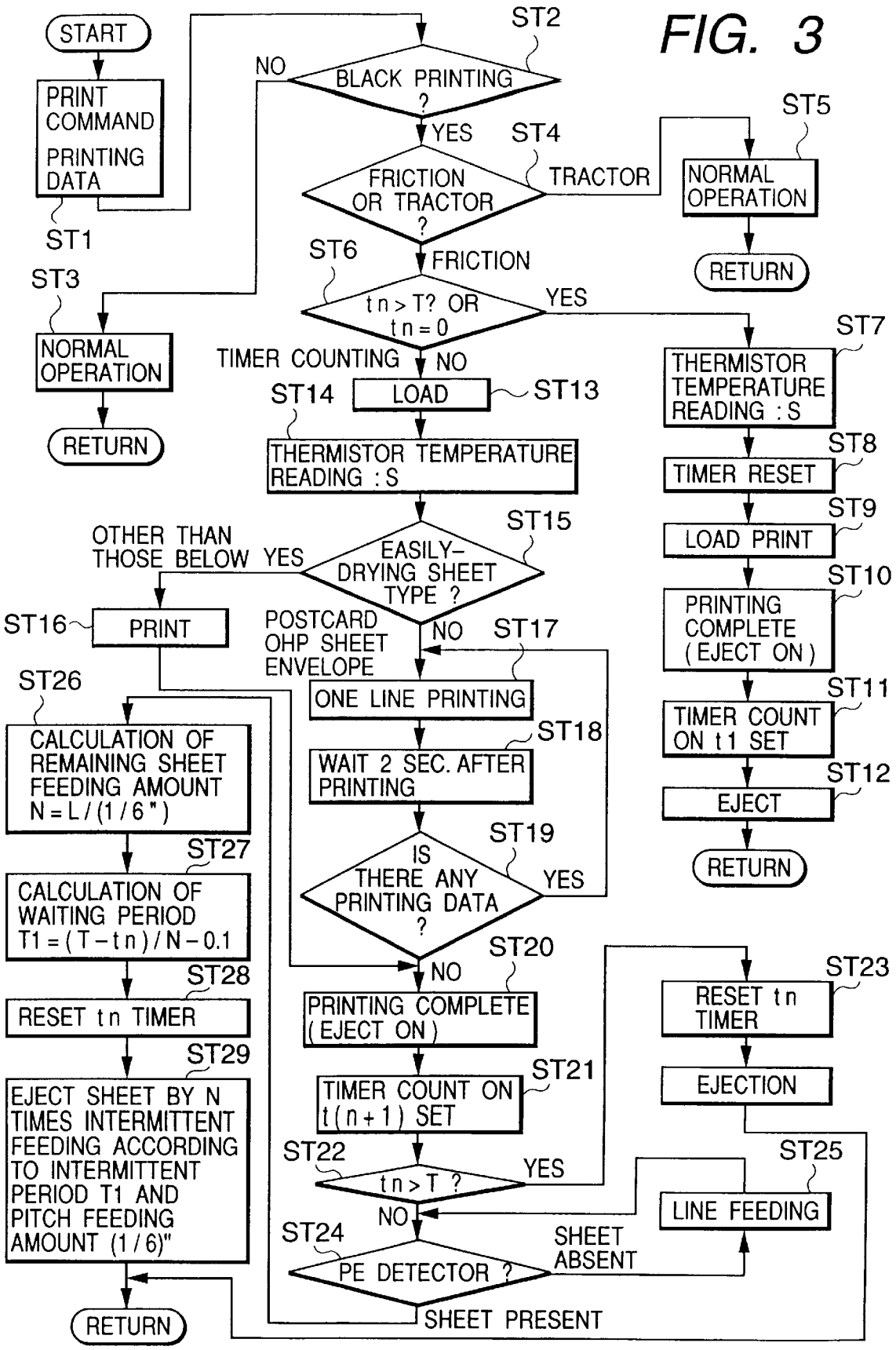
FIG. 3
START
PRINT COMMAND
PRINTING DATA
ST1
ST2
BLACK PRINTING ?
NO
YES
ST3
NORMAL OPERATION
RETURN
ST4
FRICTION OR TRACTOR ?
TRACTOR
FRICTION
ST5
NORMAL OPERATION
RETURN
ST6
tn > T? OR tn = 0
YES
TIMER COUNTING
NO
ST14
LOAD
ST13
THERMISTOR TEMPERATURE READING : S
ST7
THERMISTOR TEMPERATURE READING : S
ST8
TIMER RESET
ST9
LOAD PRINT
ST10
PRINTING COMPLETE (EJECT ON)
ST11
TIMER COUNT ON t1 SET
ST12
EJECT
RETURN
ST15
EASILY-DRYING SHEET TYPE ?
OTHER THAN THOSE BELOW
YES
ST16
PRINT
POSTCARD OHP SHEET ENVELOPE
NO
ST17
ONE LINE PRINTING
ST18
WAIT 2 SEC. AFTER PRINTING
ST19
IS THERE ANY PRINTING DATA ?
YES
NO
ST20
PRINTING COMPLETE (EJECT ON)
ST21
TIMER COUNT ON t(n+1) SET
ST22
tn > T ?
YES
NO
ST24
PE DETECTOR ?
SHEET ABSENT
SHEET PRESENT
ST23
RESET tn TIMER
EJECTION
ST25
LINE FEEDING
ST26
CALCULATION OF REMAINING SHEET FEEDING AMOUNT N = L / (1/6")
ST27
CALCULATION OF WAITING PERIOD T1 = (T − tn) / N − 0.1
ST28
RESET tn TIMER
ST29
EJECT SHEET BY N TIMES INTERMITTENT FEEDING ACCORDING TO INTERMITTENT PERIOD T1 AND PITCH FEEDING AMOUNT (1/6)"
RETURN

| THERMISTOR TEMPERATURE : S | SET PERIOD T |
|---|---|
| 10°C | 50 sec |
| 10°C < S < 15°C | 40 sec |
| 15°C < S < 20°C | 32 sec |
| 20°C < S < 25°C | 27 sec |
| 25°C < S < 30°C | 20 sec |
| 30°C OR MORE | 15 sec |

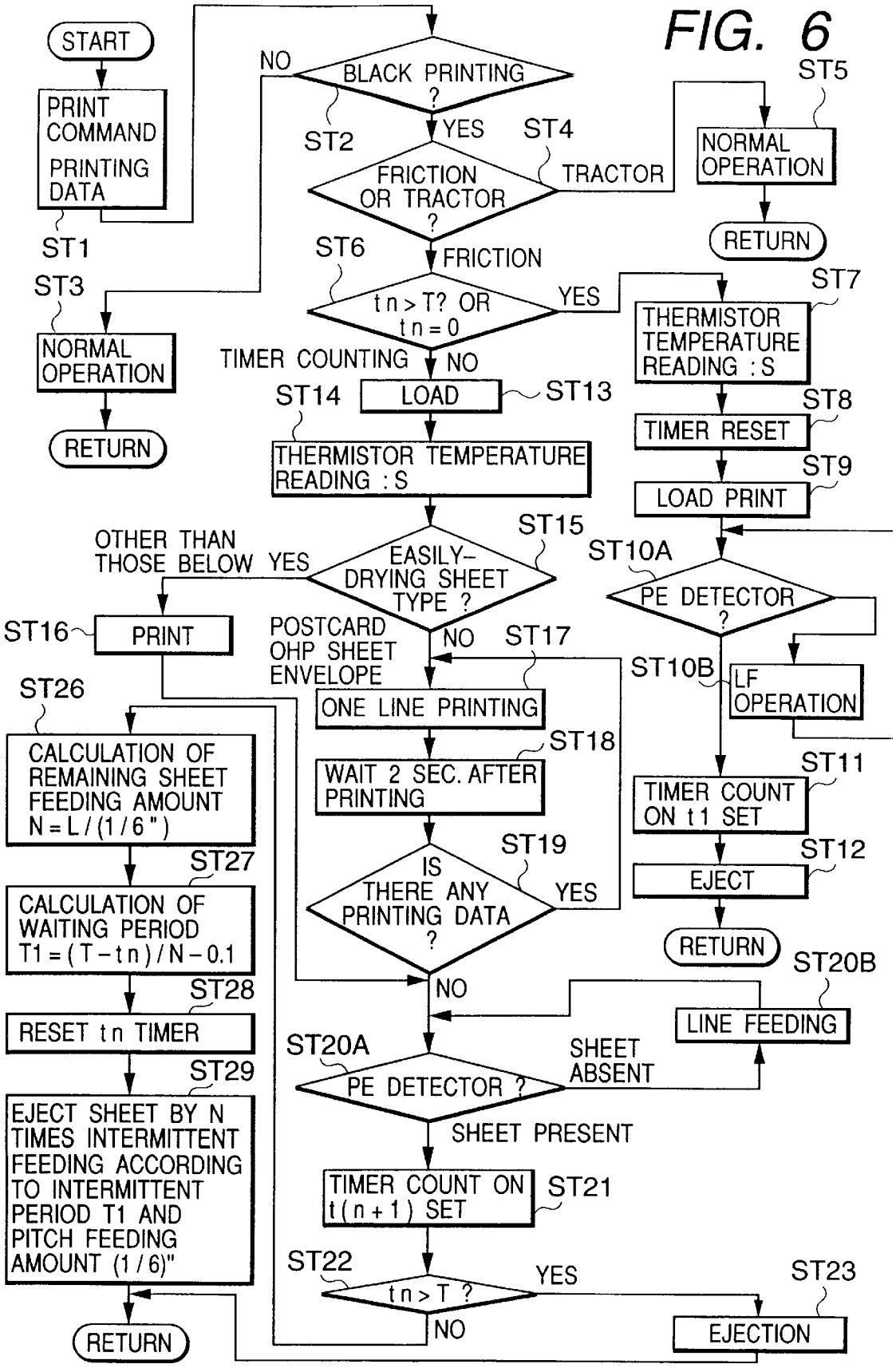
FIG. 6
START
PRINT COMMAND PRINTING DATA
ST1
BLACK PRINTING ?
NO
YES
ST2
FRICTION OR TRACTOR ?
ST4
TRACTOR
FRICTION
ST5
NORMAL OPERATION
RETURN
ST3
NORMAL OPERATION
RETURN
ST6
t n > T? OR t n = 0
YES
NO
TIMER COUNTING
ST7
THERMISTOR TEMPERATURE READING : S
ST8
TIMER RESET
ST9
LOAD PRINT
ST14
LOAD
ST13
THERMISTOR TEMPERATURE READING : S
ST15
EASILY-DRYING SHEET TYPE ?
OTHER THAN THOSE BELOW
YES
ST16
PRINT
POSTCARD OHP SHEET ENVELOPE
NO
ST17
ONE LINE PRINTING
ST18
WAIT 2 SEC. AFTER PRINTING
ST19
IS THERE ANY PRINTING DATA ?
YES
NO
ST10A
PE DETECTOR ?
ST10B
LF OPERATION
ST11
TIMER COUNT ON t1 SET
ST12
EJECT
RETURN
ST20B
LINE FEEDING
ST20A
PE DETECTOR ?
SHEET ABSENT
SHEET PRESENT
ST21
TIMER COUNT ON t(n+1) SET
ST22
t n > T ?
YES
NO
ST23
EJECTION
ST26
CALCULATION OF REMAINING SHEET FEEDING AMOUNT N = L / (1 / 6")
ST27
CALCULATION OF WAITING PERIOD T1 = (T − t n) / N − 0.1
ST28
RESET t n TIMER
ST29
EJECT SHEET BY N TIMES INTERMITTENT FEEDING ACCORDING TO INTERMITTENT PERIOD T1 AND PITCH FEEDING AMOUNT (1 / 6)"
RETURN

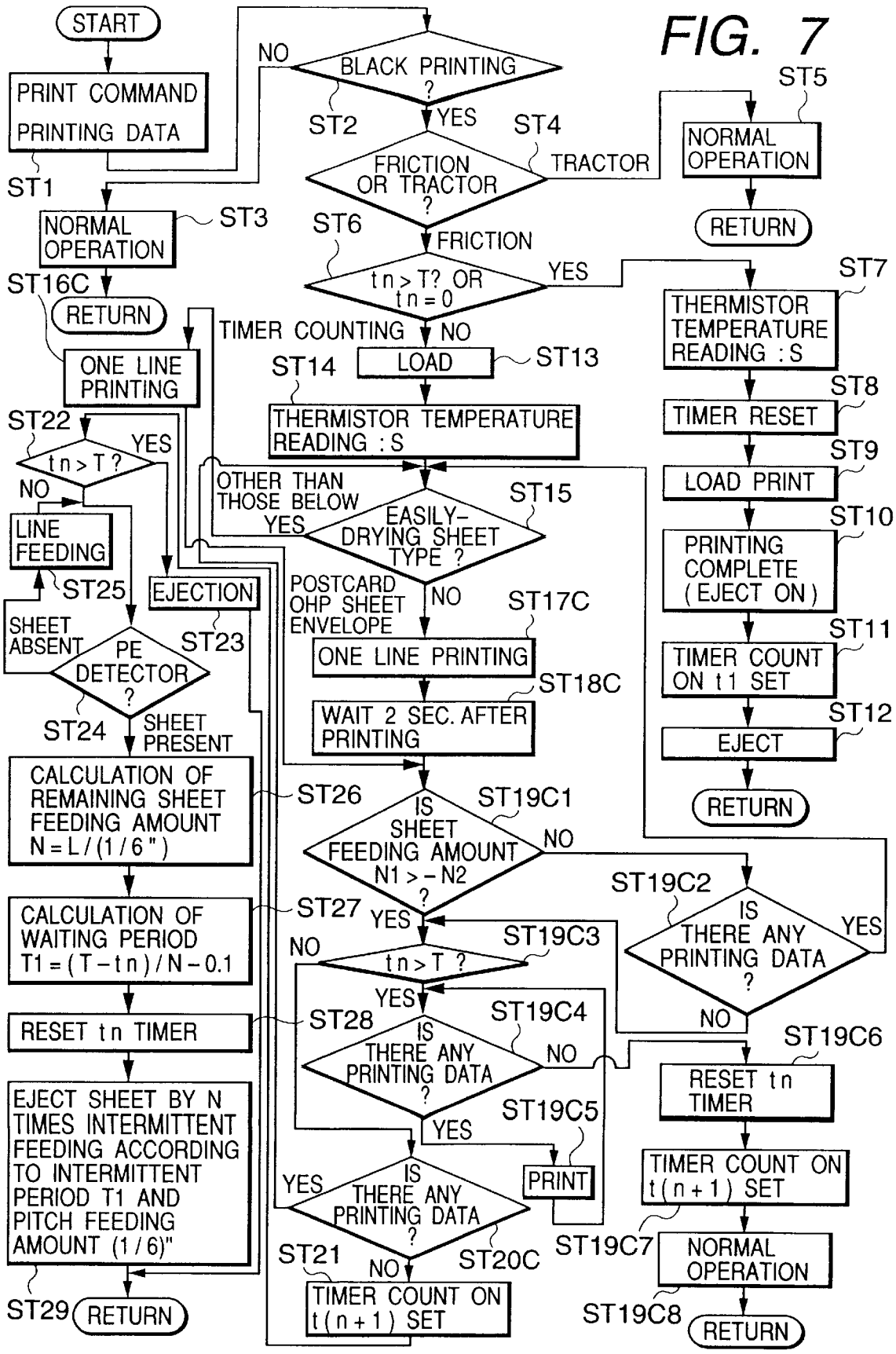
FIG. 7
START
PRINT COMMAND
PRINTING DATA
ST1
NORMAL OPERATION
ST3
ST16C
RETURN
ONE LINE PRINTING
ST22
tn > T ?
YES
NO
LINE FEEDING
ST25
EJECTION
ST23
SHEET ABSENT
PE DETECTOR ?
ST24
SHEET PRESENT
CALCULATION OF REMAINING SHEET FEEDING AMOUNT N = L / (1/6")
ST26
CALCULATION OF WAITING PERIOD T1 = (T − tn) / N − 0.1
ST27
RESET tn TIMER
ST28
EJECT SHEET BY N TIMES INTERMITTENT FEEDING ACCORDING TO INTERMITTENT PERIOD T1 AND PITCH FEEDING AMOUNT (1/6)"
ST29
RETURN
BLACK PRINTING ?
ST2
NO
YES
FRICTION OR TRACTOR ?
ST4
TRACTOR
FRICTION
ST6
tn > T? OR tn = 0
YES
NO
TIMER COUNTING
LOAD
ST13
ST14
THERMISTOR TEMPERATURE READING : S
OTHER THAN THOSE BELOW
YES
EASILY-DRYING SHEET TYPE ?
ST15
POSTCARD OHP SHEET ENVELOPE
NO
ST17C
ONE LINE PRINTING
ST18C
WAIT 2 SEC. AFTER PRINTING
IS SHEET FEEDING AMOUNT N1 > −N2 ?
ST19C1
NO
YES
ST19C2
IS THERE ANY PRINTING DATA ?
YES
NO
ST19C3
tn > T ?
NO
YES
ST19C4
IS THERE ANY PRINTING DATA ?
NO
YES
ST19C5
PRINT
YES
IS THERE ANY PRINTING DATA ?
ST20C
NO
ST21
TIMER COUNT ON t(n+1) SET
ST5
NORMAL OPERATION
RETURN
ST7
THERMISTOR TEMPERATURE READING : S
ST8
TIMER RESET
ST9
LOAD PRINT
ST10
PRINTING COMPLETE (EJECT ON)
ST11
TIMER COUNT ON t1 SET
ST12
EJECT
RETURN
ST19C6
RESET tn TIMER
TIMER COUNT ON t(n+1) SET
ST19C7
NORMAL OPERATION
ST19C8
RETURN

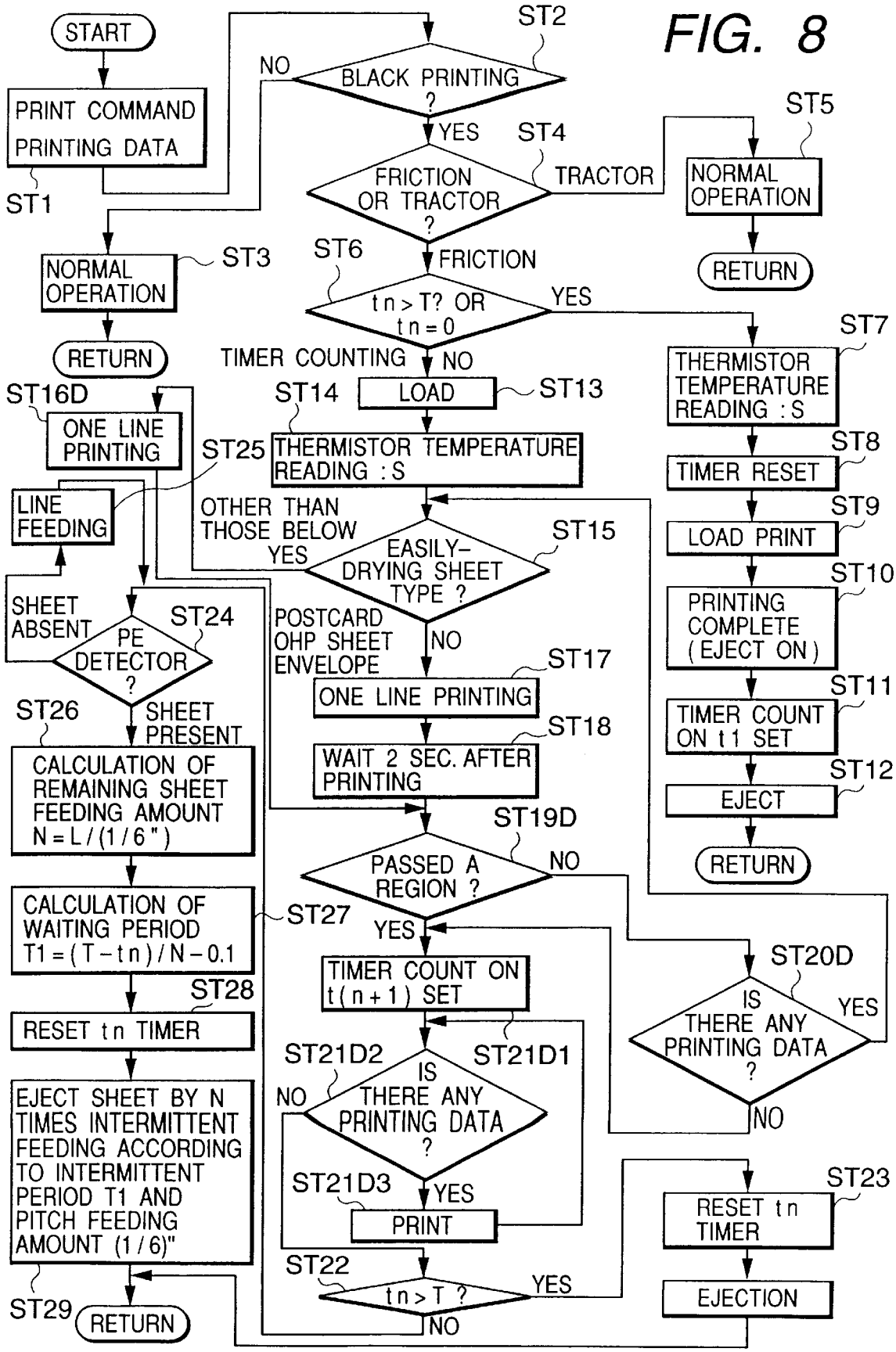
FIG. 8
START
PRINT COMMAND
PRINTING DATA
ST1
ST2
BLACK PRINTING ?
NO
YES
ST4
FRICTION OR TRACTOR ?
TRACTOR
FRICTION
ST5
NORMAL OPERATION
RETURN
NORMAL OPERATION
ST3
RETURN
ST6
tn > T? OR tn = 0
YES
TIMER COUNTING
NO
ST7
THERMISTOR TEMPERATURE READING : S
ST8
TIMER RESET
ST9
LOAD PRINT
ST10
PRINTING COMPLETE (EJECT ON)
ST11
TIMER COUNT ON t1 SET
ST12
EJECT
RETURN
ST16D
ONE LINE PRINTING
ST25
LINE FEEDING
ST14
LOAD
ST13
THERMISTOR TEMPERATURE READING : S
OTHER THAN THOSE BELOW
YES
EASILY-DRYING SHEET TYPE ?
ST15
POSTCARD OHP SHEET ENVELOPE
NO
ST17
ONE LINE PRINTING
ST18
WAIT 2 SEC. AFTER PRINTING
SHEET ABSENT
PE DETECTOR ?
ST24
SHEET PRESENT
ST26
CALCULATION OF REMAINING SHEET FEEDING AMOUNT N = L/(1/6")
CALCULATION OF WAITING PERIOD T1 = (T − tn)/N − 0.1
ST27
ST28
RESET tn TIMER
EJECT SHEET BY N TIMES INTERMITTENT FEEDING ACCORDING TO INTERMITTENT PERIOD T1 AND PITCH FEEDING AMOUNT (1/6)"
ST29
RETURN
ST19D
PASSED A REGION ?
NO
YES
TIMER COUNT ON t(n+1) SET
ST21D1
ST21D2
IS THERE ANY PRINTING DATA ?
NO
ST21D3
YES
PRINT
ST22
tn > T ?
YES
NO
ST20D
IS THERE ANY PRINTING DATA ?
YES
NO
ST23
RESET tn TIMER
EJECTION

| PAPER SIZE | A ( mm ) | P4 ( PULSE ) |
|---|---|---|
| A5 PORTRAIT | 50 | P4a |
| B5 PORTRAIT | 70 | P4b |
| A4 PORTRAIT | 90 | P4c |
| B4 PORTRAIT | 160 | P4d |
| A3 PORTRAIT | 220 | P4e |
| OTHER THAN THE ABOVE | 200 | P4f |

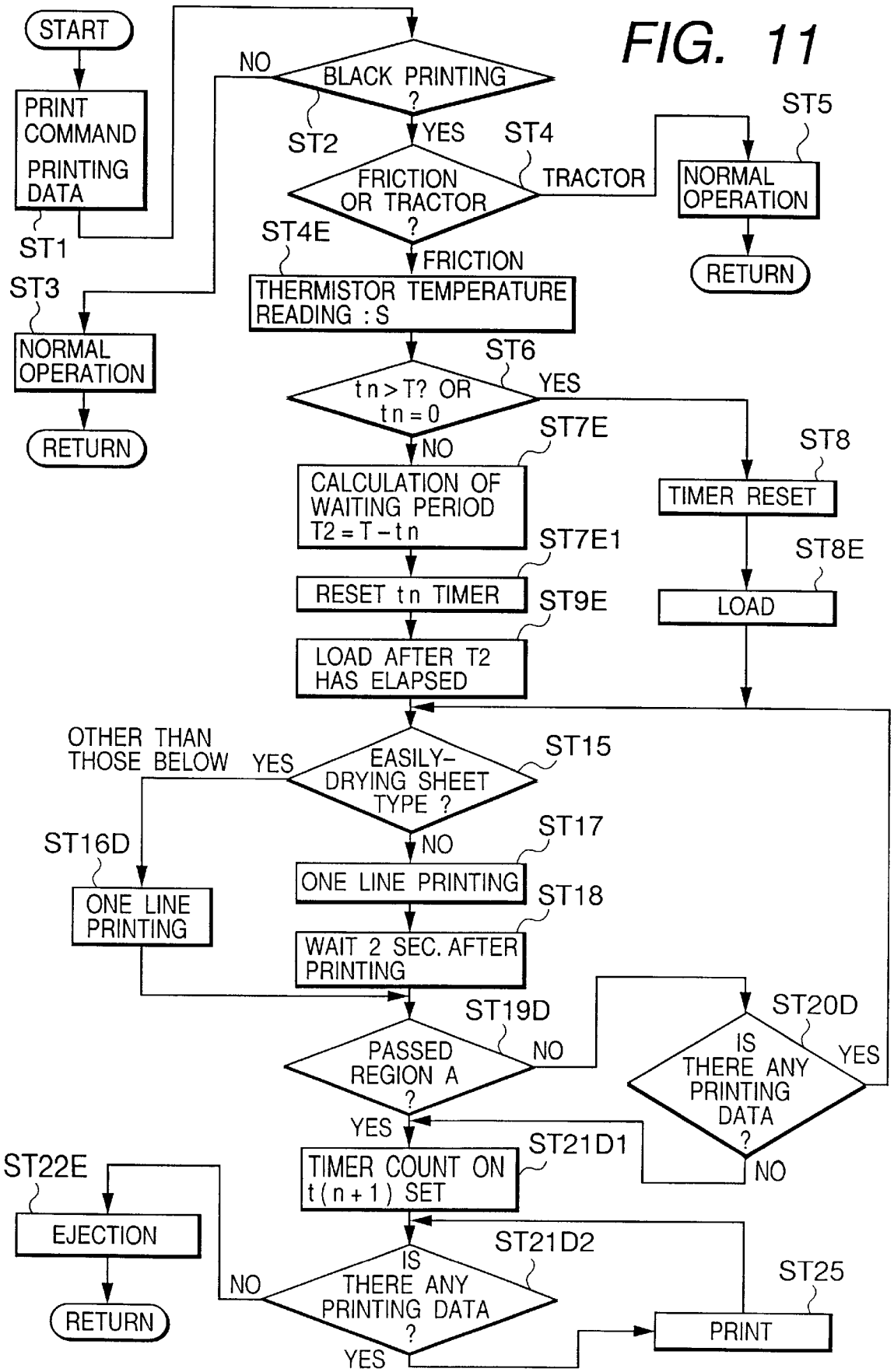
FIG. 11
START
PRINT COMMAND PRINTING DATA
ST1
BLACK PRINTING ?
ST2
NO
YES
FRICTION OR TRACTOR ?
ST4
TRACTOR
FRICTION
ST5
NORMAL OPERATION
RETURN
ST3
NORMAL OPERATION
RETURN
ST4E
THERMISTOR TEMPERATURE READING : S
ST6
tn > T? OR tn = 0
YES
NO
ST7E
CALCULATION OF WAITING PERIOD T2 = T − tn
ST7E1
RESET tn TIMER
ST9E
LOAD AFTER T2 HAS ELAPSED
ST8
TIMER RESET
ST8E
LOAD
OTHER THAN THOSE BELOW
YES
EASILY-DRYING SHEET TYPE ?
ST15
NO
ST16D
ONE LINE PRINTING
ST17
ONE LINE PRINTING
ST18
WAIT 2 SEC. AFTER PRINTING
ST19D
PASSED REGION A ?
NO
YES
ST20D
IS THERE ANY PRINTING DATA ?
YES
NO
ST21D1
TIMER COUNT ON t(n+1) SET
ST22E
EJECTION
RETURN
ST21D2
IS THERE ANY PRINTING DATA ?
NO
YES
ST25
PRINT

| PRINT DENSITY | FACTOR (a) |
|---|---|
| 0 ~ 10% | 0. 2 |
| 11 ~ 20% | 0. 4 |
| 21 ~ 40% | 0. 6 |
| 41 ~ 60% | 0. 8 |
| 61% OR MORE | 1. 0 |

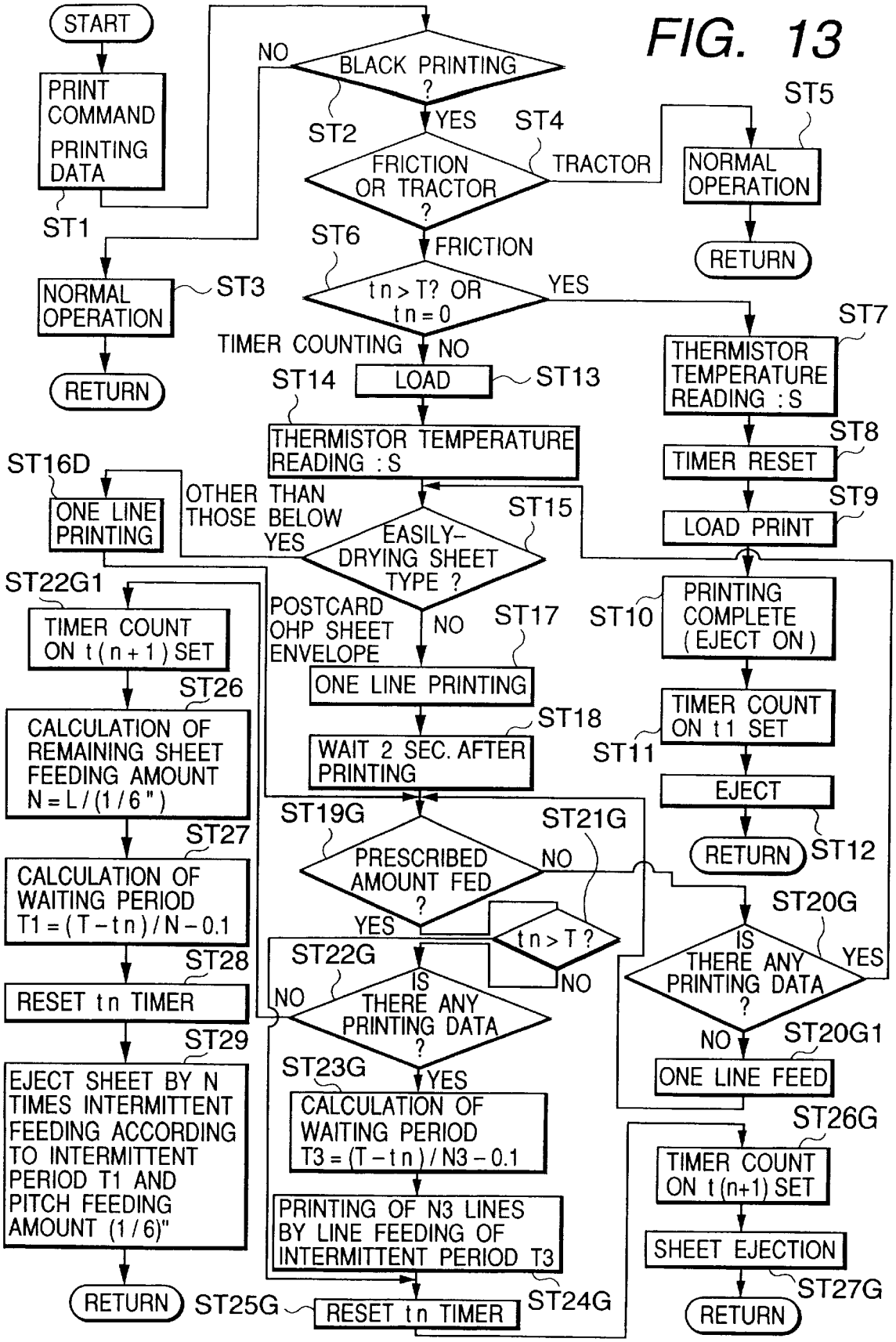
FIG. 13
START
PRINT COMMAND PRINTING DATA
ST1
NO
BLACK PRINTING ?
ST2
YES
ST4
FRICTION OR TRACTOR ?
TRACTOR
ST5
NORMAL OPERATION
RETURN
FRICTION
ST6
tn > T? OR tn = 0
YES
NORMAL OPERATION
ST3
RETURN
TIMER COUNTING
NO
LOAD
ST13
ST14
THERMISTOR TEMPERATURE READING : S
ST7
THERMISTOR TEMPERATURE READING : S
ST8
TIMER RESET
ST9
LOAD PRINT
ST16D
ONE LINE PRINTING
OTHER THAN THOSE BELOW
YES
ST15
EASILY-DRYING SHEET TYPE ?
POSTCARD OHP SHEET ENVELOPE
NO
ST17
ONE LINE PRINTING
ST18
WAIT 2 SEC. AFTER PRINTING
ST10
PRINTING COMPLETE (EJECT ON)
ST11
TIMER COUNT ON t1 SET
EJECT
ST12
RETURN
ST22G1
TIMER COUNT ON t(n+1) SET
ST26
CALCULATION OF REMAINING SHEET FEEDING AMOUNT N = L/(1/6")
ST27
CALCULATION OF WAITING PERIOD T1 = (T − tn)/N − 0.1
ST28
RESET tn TIMER
ST29
EJECT SHEET BY N TIMES INTERMITTENT FEEDING ACCORDING TO INTERMITTENT PERIOD T1 AND PITCH FEEDING AMOUNT (1/6)"
RETURN
ST19G
PRESCRIBED AMOUNT FED ?
NO
ST21G
YES
tn > T ?
NO
ST22G
IS THERE ANY PRINTING DATA ?
NO
YES
ST23G
CALCULATION OF WAITING PERIOD T3 = (T − tn)/N3 − 0.1
PRINTING OF N3 LINES BY LINE FEEDING OF INTERMITTENT PERIOD T3
ST24G
ST25G
RESET tn TIMER
ST20G
IS THERE ANY PRINTING DATA ?
YES
NO
ST20G1
ONE LINE FEED
ST26G
TIMER COUNT ON t(n+1) SET
SHEET EJECTION
ST27G
RETURN

INK JET PRINTING METHOD FOR FEEDING AND EJECTING A SHEET TO PREVENT A SHEET FROM ADHERING TO A SUCCESSIVE SHEET

BACKGROUND OF THE INVENTION

1. Field of the Invention

The invention relates to an ink jet recording method. In particular, the invention relates to an ink jet recording method wherein a plurality of sheets (normal paper, coated paper, postcards, envelopes, OHP (overhead projector) sheets etc.) are fed to an ink jet head one at a time, and after being printed by ink drops being discharged in the direction of the sheet by means of the ink jet head, the sheets are ejected in a stack one after the other.

2. Description of the Related Art

In Japanese Patent Publication No. Hei 2-245356, when a sheet is ejected before the ink discharged on the surface of the sheet is fixed, ink remaining on the surface of the sheet contacts pinch rollers and paper guides in the paper ejection path and this leads to the problem of paper smudging or staining of the apparatus. This problem must be solved, so when printing is finished, paper feeding is suspended (the paper is left to stand) for a prescribed period and after that, it is ejected; that is, a technique for delaying the paper ejection operation for a prescribed period is disclosed.

On the other hand, in an ink jet recording method of the type where already printed sheets are ejected one by one in a stack, when a plurality of sheets is continuously printed, while the ink on an already printed and ejected sheet is not yet fixed, the next sheet is ejected, it is dropped onto the printed surface of the former ejected sheet and there is the problem of smudging of the printed surface of the former ejected sheet.

This kind of problem can probably be solved in the above-mentioned conventional technology by suspending paper feeding (leaving the paper to stand) for a prescribed period after printing has finished.

However, when continually printing a plurality of sheets, after printing is completed, halting an already printed sheet for a prescribed period before ejecting the sheet leads to a feeling of uneasiness on the part of the user.

That is, regardless of whether the sheet is already printed or not, it is undesirable to create a state of anxiety in the user as to whether or not the recording apparatus has suffered a breakdown, due to that sheet having been halted for a prescribed period.

An objective of this invention is to solve the abovementioned problem; to prevent smudging of printed surfaces of already ejected sheets in an ink jet recording method of the type where already printed sheets are ejected one by one in a stack, without causing the user to become anxious.

SUMMARY OF THE INVENTION

In order to achieve the above-mentioned objective, an ink jet recording method wherein multiple sheets are fed one by one towards an ink jet head and are ejected stacked one on top of another after printing by means of the ink jet head is provided, comprising the steps of: setting a period necessary for ink printed on a former sheet to be fixed enough that it does not adhere to a successive sheet stacked on top of said former sheet; measuring an elapsed period from a point in time when printing on said former sheet is completed; comparing said elapsed period with said set period when said successive sheet is ejected; and if said elapsed period has not reached said set period, ejecting said successive sheet by means of an intermittent feeding operation in which said successive sheet slidingly contacts said former sheet due to the ejection operation of said successive sheet at a point in time when said elapsed period exceeds said set period.

The ink jet recording method of claim 2, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; measuring an elapsed period from a point in time when printing on said former sheet is completed; comparing said elapsed period with said set period when said successive sheet is ejected; and if said elapsed period has not reached said set period, ejecting said successive sheet at a prescribed ejection speed whereby said successive sheet slidingly contacts said former sheet due to the ejection operation of said successive sheet at a point in time when said elapsed period exceeds said set period.

The ink jet recording method of claim 3, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; detecting a trailing edge of said former sheet; measuring an elapsed period from a point in time when the trailing edge of said former sheet is detected; comparing said elapsed period with said set period when said successive sheet is ejected; and if said elapsed period has not reached said set period, ejecting said successive sheet by means of an intermittent feeding operation in which said successive sheet slidingly contacts said former sheet due to the ejection operation of said successive sheet at a point in time when said elapsed period exceeds said set period.

The ink jet recording method of claim 4, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; detecting a trailing edge of said former sheet, measuring an elapsed period from a point in time when the trailing edge of said former sheet is detected; comparing said elapsed period with said set period when said successive sheet is ejected; and if said elapsed period has not reached said set period, ejecting said successive sheet at a prescribed ejection speed whereby said successive sheet slidingly contacts said former sheet due to the ejection operation of said successive sheet at a point in time when said elapsed period exceeds said set period.

The ink jet recording method of claim 5, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; measuring an elapsed period from a point in time when printing on said former sheet is completed; comparing said elapsed period with said set period at a point in time when a prescribed amount of said successive sheet has been fed; and if said elapsed period has not reached said set period, ejecting said successive sheet at a feeding speed of a prescribed number of lines whereby said successive sheet slidingly contacts said former sheet at a point in time when said elapsed period exceeds said set period. Furthermore, "feeding speed of a prescribed number of lines" includes the case wherein the actual sheet feeding speed is set at a prescribed speed, and the case wherein the time interval of feeding by a number of lines—that is intermittent feeding—is set at a prescribed time interval.

The ink jet recording method of claim 6, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; detecting a trailing edge of said former sheet; measuring an elapsed period from a point in time when the trailing edge of said former sheet is detected, comparing said elapsed period with said set period at a point in time when a prescribed amount of said successive sheet has been fed; and if said elapsed period has not reached said set period, printing said successive sheet at a feeding speed of a prescribed number of lines whereby said successive sheet slidingly contacts said former sheet at a point in time when said elapsed period exceeds said set period.

The ink jet recording method of claim 7, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; measuring an elapsed period from a point in time when printing on said former sheet is completed; comparing said elapsed period with said set period at a point in time when a prescribed amount of said successive sheet has been fed; and if said elapsed period has not reached said set period, ejecting said successive sheet after the printing operation is completed by means of an intermittent feeding operation in which said successive sheet slidingly contacts said former sheet at a point in time when said elapsed period exceeds said set period.

The ink jet recording method of claim 8, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; measuring an elapsed period from a point in time when printing on said former sheet is completed; comparing said elapsed period with said set period at a point in time when a prescribed amount of said successive sheet has been fed; and if said elapsed period has not reached said set period, ejecting said successive sheet after the printing operation is completed at a prescribed ejection speed whereby said successive sheet slidingly contacts said former sheet at a point in time when said elapsed period exceeds said set period.

The ink jet recording method of claim 9, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; detecting a trailing edge of said former sheet, measuring an elapsed period from a point in time when the trailing edge of said former sheet is detected; comparing said elapsed period with said set period at a point in time when a prescribed amount of said successive sheet has been fed; and if said elapsed period has not reached said set period, ejecting said successive sheet after the printing operation is completed by means of an intermittent feeding operation in which said successive sheet slidingly contacts said former sheet at a point in time when said elapsed period exceeds said set period.

The ink jet recording method of claim 10, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; detecting a trailing edge of said former sheet, measuring an elapsed period from a point in time when the trailing edge of said former sheet is detected; comparing said elapsed period with said set period at a point in time when a prescribed amount of said successive sheet has been fed; and if said elapsed period has not reached said set period, ejecting said successive sheet after the printing operation is completed at a prescribed ejection speed whereby said successive sheet slidingly contacts said former sheet at a point in time when said elapsed period exceeds said set period.

The ink jet recording method of claim 11, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; measuring an elapsed period from a point in time when printing up to the region of said former sheet where it slidingly contacts said successive sheet is completed; comparing said elapsed period with said set period when said successive sheet is ejected; and if said elapsed period has not reached said set period, ejecting said successive sheet by means of an intermittent feeding operation in which said successive sheet slidingly contacts said former sheet due to the ejection operation of said successive sheet at a point in time when said elapsed period exceeds said set period.

The ink jet recording method of claim 12, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; measuring an elapsed period from a point in time when printing up to the region of said former sheet where it slidingly contacts said successive sheet is completed; comparing said elapsed period with said set period when said successive sheet is ejected; and if said elapsed period has not reached said set period, ejecting said successive sheet at a prescribed ejection speed whereby said successive sheet slidingly contacts said former sheet due to the ejection operation of said successive sheet at a point in time when said elapsed period exceeds said set period.

The ink jet recording method of claim 13, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; measuring an elapsed period from a point in time when printing up to the region of said former sheet where it slidingly contacts said successive sheet is completed; comparing said elapsed period with said set period when said successive sheet is fed; and if said elapsed period has not reached said set period, feeding said successive sheet after a prescribed period has elapsed whereby said successive sheet slidingly contacts said former sheet at a point in time when said elapsed period exceeds said set period.

The ink jet recording method of claim 14, wherein multiple sheets are fed one by one towards an ink jet head and are ejected stacked one on top of another after printing by means of the ink jet head, comprises the steps of: setting a period necessary for ink printed on a former sheet to be fixed enough that it does not adhere to a successive sheet stacked on top of said former sheet; measuring an elapsed period from a point in time when printing up to the region of said former sheet where it slidingly contacts said successive sheet is completed; comparing said elapsed period with said set period when said successive sheet is fed; and if said elapsed period has not reached said set period, feeding said successive sheet at a prescribed feeding speed whereby said successive sheet slidingly contacts said former sheet at a point in time when said elapsed period exceeds said set period.

The ink jet recording method of claim 15 comprises the ink jet recording method of any one of claims 1 to 14, wherein the temperature of the vicinity of either said ink jet head or said sheet is measured, and said set period is set corresponding to that temperature.

The ink jet recording method of claim 16 comprises the ink jet recording method of any one of claims 1 to 15, wherein the printing density of said former sheet is measured, and said set period is set corresponding to that printing density.

The ink jet recording method of claim 17 comprises the ink jet recording method of claim 16, wherein the measurement of the printing density of said former sheet is the measurement of the printing density of that region in sliding contact with said successive sheet.

The ink jet recording method of claim 18 comprises the ink jet recording method of any one of claims 1 to 17, wherein the length of said former sheet is measured, and said set period is set corresponding to that length.

The ink jet recording method of claim 19 comprises the ink jet recording method of any one of claims 1 to 18, wherein said set period is set corresponding to the material of said former sheet.

The ink jet recording method of claim 20 comprises the ink jet recording method of any one of claims 1 to 19, wherein said set period is set corresponding to the type of ink ejected from said ink jet head.

According to the ink jet recording method of claim 1, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set and an elapsed period from a point in time when printing on said former sheet is completed is measured.

Then, when said successive sheet is ejected , said elapsed period is compared with said set period and if said elapsed period has not reached said set period, said successive sheet is ejected by means of an intermittent feeding operation in which said successive sheet slidingly contacts said former sheet due to the ejection operation of said successive sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected by means of an intermittent feeding operation, the user does not suffer from a feeling of uneasiness.

That is, according to the ink jet recording method of claim 1, smudging of the printed surface of already ejected sheets can be prevented without causing a feeling of uneasiness in the user in an ink jet recording method of the type wherein already printed sheets are ejected stacked one on top of the other.

According to the ink jet recording method of claim 2, multiple sheets are fed one by one towards an ink jet head, printed by means of an ink jet head, and after that they are ejected and stacked one on top of another.

Next, a period necessary for ink printed on a former sheet to be fixed enough that it does not adhere to a successive sheet stacked on top of said former sheet is set and an elapsed period from a point in time when printing on said former sheet is completed is measured.

Then, when said successive sheet is ejected, said elapsed period is compared with said set period and if said elapsed period has not reached said set period, said successive sheet is ejected at a prescribed feeding speed whereby said successive sheet slidingly contacts said former sheet due to the ejection operation of said successive sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected at a prescribed feeding speed, the user does not suffer from a feeling of uneasiness.

That is, according to the ink jet recording method of claim 2, smudging of the printed surface of already ejected sheets can be prevented without causing a feeling of uneasiness in the user in an ink jet recording method of the type wherein already printed sheets are ejected stacked one on top of the other.

According to the ink jet recording method of claim 3, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set, the trailing edge of said former sheet is detected, and an elapsed period from a point in time when the trailing edge of said former sheet is detected is measured.

Then, when said successive sheet is ejected , said elapsed period is compared with said set period and if said elapsed period has not reached said set period, said successive sheet is ejected by means of an intermittent feeding operation in which said successive sheet slidingly contacts said former sheet due to the ejection operation of said successive sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected by means of an intermittent feeding operation, the user does not suffer from a feeling of uneasiness.

Moreover, as the measurement of said elapsed period is carried out from the point in time when the trailing edge of the former sheet is detected, it is possible to prevent smudging of the printed surface of already ejected sheets more reliably. When measurement of the elapsed period is carried out from the point in time when printing of the former sheet is completed, the determination of the point in time when that printing is completed is by no means easy, but compared to this detection of the trailing edge of the former sheet can be carried out reliably.

That is, according to the ink jet recording method of claim 3, smudging of the printed surface of already ejected sheets can be reliably prevented without causing a feeling of uneasiness in the user in an ink jet recording method of the type wherein already printed sheets are ejected stacked one on top of the other.

According to the ink jet recording method of claim 4, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set, the trailing edge of said former sheet is detected, and an elapsed period from a point in time when the trailing edge of said former sheet is detected is measured.

Then, when said successive sheet is ejected, said elapsed period is compared with said set period and if said elapsed period has not reached said set period, said successive sheet is ejected at a prescribed feeding speed whereby said successive sheet slidingly contacts said former sheet due to the ejection operation of said successive sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected at a prescribed feeding speed, the user does not suffer from a feeling of uneasiness.

Moreover, as the measurement of said elapsed period is carried out from the point in time when the trailing edge of the former sheet is detected, it is possible to prevent smudging of the printed surface of already ejected sheets more reliably.

That is, according to the ink jet recording method of claim 4, smudging of the printed surface of already ejected sheets can be reliably prevented without causing a feeling of uneasiness in the user in an ink jet recording method of the type wherein already printed sheets are ejected stacked one on top of the other.

According to the ink jet recording method of claim 5, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set and an elapsed period from a point in time when printing on said former sheet is completed is measured.

Then, when said successive sheet has been fed a prescribed amount, said elapsed period is compared with said set period and if said elapsed period has not reached said set period, said successive sheet is printed at a feeding speed of a prescribed number of lines whereby said successive sheet slidingly contacts said former sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected at a prescribed feeding speed, the user does not suffer from a feeling of uneasiness.

That is, according to the ink jet recording method of claim 5, smudging of the printed surface of already ejected sheets can be reliably prevented without causing a feeling of uneasiness in the user in an ink jet recording method of the type wherein already printed sheets are ejected stacked one on top of the other.

According to the ink jet recording method of claim 6, multiple sheets are fed one by one towards an ink jet head and are ejected and stacked one on top of another after printing by means of the ink jet head.

Next, a period-necessary for ink printed on a former sheet to be fixed enough that it does not adhere to a successive sheet stacked on top of said former sheet is set, the trailing edge of said former sheet is detected, and an elapsed period from a point in time when the trailing edge of said former sheet is detected is measured.

Then, when said successive sheet has been fed a prescribed amount, said elapsed period is compared with said set period and if said elapsed period has not reached said set period, said successive sheet is printed at a feeding speed of a prescribed number of lines whereby said successive sheet slidingly contacts said former sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is printed at a prescribed feeding speed, the user does not suffer from a feeling of uneasiness.

Moreover, as the measurement of said elapsed period is carried out from the point in time when the trailing edge of the former sheet is detected, it is possible to prevent smudging of the printed surface of already ejected sheets more reliably.

That is, according to the ink jet recording method of claim 6, smudging of the printed surface of already ejected sheets can be reliably prevented without causing a feeling of uneasiness in the user in an ink jet recording method of the type wherein already printed sheets are ejected stacked one on top of the other.

According to the ink jet recording method of claim 7, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set and an elapsed period from a point in time when printing on said former sheet is completed is measured.

Then, when said successive sheet is ejected, said elapsed period is compared with said set period and if said elapsed period has not reached said set period, said successive sheet is ejected by means of an intermittent feeding operation in which said successive sheet slidingly contacts said former sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected by means of an intermittent feeding operation, the user does not suffer from a feeling of uneasiness.

That is, according to the ink jet recording method of claim 7, smudging of the printed surface of already ejected sheets can be prevented without causing a feeling of uneasiness in the user in an ink jet recording method of the type wherein already printed sheets are ejected stacked one on top of the other.

According to the ink jet recording method of claim 8, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set and an elapsed period from a point in time when printing on said former sheet is completed is measured.

Then, when said successive sheet is ejected, said elapsed period is compared with said set period and if said elapsed period has not reached said set period, said successive sheet is ejected at a prescribed feeding speed whereby said successive sheet slidingly contacts said former sheet due to the ejection operation of said successive sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected at a prescribed feeding speed, the user does not suffer from a feeling of uneasiness.

That is, according to the ink jet recording method of claim 8, smudging of the printed surface of already ejected sheets can be prevented without causing a feeling of uneasiness in the user in an ink jet recording method of the type wherein already printed sheets are ejected stacked one on top of the other.

According to the ink jet recording method of claim 9, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set, the trailing edge of said former sheet is detected, and an elapsed period from a point in time when the trailing edge of said former sheet is detected is measured.

Then, when said successive sheet is ejected, said elapsed period is compared with said set period and if said elapsed period has not reached said set period, said successive sheet is ejected by means of an intermittent feeding operation in which said successive sheet slidingly contacts said former sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected by means of an intermittent feeding operation, the user does not suffer from a feeling of uneasiness.

Moreover, as the measurement of said elapsed period is carried out from the point in time when the trailing edge of the former sheet is detected, it is possible to prevent smudging of the printed surface of already ejected sheets more reliably.

That is, according to the ink jet recording method of claim 9, smudging of the printed surface of already ejected sheets can be reliably prevented without causing a feeling of uneasiness in the user in an ink jet recording method of the type wherein already printed sheets are ejected stacked one on top of the other.

According to the ink jet recording method of claim 10, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set, the trailing edge of said former sheet is detected, and an elapsed period from a point in time when the trailing edge of said former sheet is detected is measured.

Then, when said successive sheet is ejected, said elapsed period is compared with said set period and if said elapsed period has not reached said set period, said successive sheet is ejected after printing at a prescribed feeding speed whereby said successive sheet slidingly contacts said former sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected at a prescribed feeding speed, the user does not suffer from a feeling of uneasiness.

Moreover, as the measurement of said elapsed period is carried out from the point in time when the trailing edge of the former sheet is detected, it is possible to prevent smudging of the printed surface of already ejected sheets more reliably.

That is, according to the ink jet recording method of claim 10, smudging of the printed surface of already ejected sheets can be prevented without causing a feeling of uneasiness in the user in an ink jet recording method of the type wherein already printed sheets are ejected stacked one on top of the other.

According to the ink jet recording method of claim 11, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set and an elapsed period from a point in time when printing on said former sheet is completed is measured.

Then, when said successive sheet is ejected, said elapsed period is compared with said set period and if said elapsed period has not reached said set period, said successive sheet is ejected by means of an intermittent feeding operation in which said successive sheet slidingly contacts said former sheet due to the ejection operation of said successive sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected by means of an intermittent feeding operation, the user does not suffer from a feeling of uneasiness.

Moreover, as the measurement of said elapsed period is carried out from the point in time when printing up to the region of the former sheet where it slidingly contacts said successive sheet is completed, it is possible to prevent smudging of the printed surface of already ejected sheets more reliably.

Generally speaking, the region where a successive sheet slidingly contacts a former sheet is a somewhat limited region. Consequently, it is very important whether or not the ink is fixed in this region.

According to this ink jet recording method of claim 11, as said elapsed period is measured from the point in time when printing is completed to this region, the ejection of the successive sheet is not unneccessarily delayed, and effective ejection is possible.

That is, according to the ink jet recording method of claim 11, smudging of the printed surface of already ejected sheets can be prevented while sheets are effectively ejected without causing a feeling of uneasiness in the user in an ink jet recording method of the type wherein already printed sheets are ejected stacked one on top of the other.

According to the ink jet recording method of claim 12, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set, and an elapsed period is measured from a point in time when printing up to the region of said former sheet where it slidingly contacts said successive sheet is completed.

Then, when said successive sheet is ejected , said elapsed period is compared with said set period and if said elapsed period has not reached said set period, said successive sheet is ejected at a prescribed ejection speed whereby said successive sheet slidingly contacts said former sheet due to the ejection operation of said successive sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is ejected at a prescribed feeding speed, the user does not suffer from a feeling of uneasiness.

Moreover, as the measurement of said elapsed period is carried out from the point in time when printing up to the region of the former sheet where it slidingly contacts said successive sheet is completed, it is possible for successive sheets to be ejected more effectively.

That is, according to the ink jet recording method of claim 12, smudging of the printed surface of already ejected sheets can be prevented while sheets are effectively ejected without causing a feeling of uneasiness in the user in an ink jet recording method of the type wherein already printed sheets are ejected stacked one on top of the other.

According to the ink jet recording method of claim 13, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set, and an elapsed period is measured from a point in time when printing up to the region of said former sheet where it slidingly contacts said successive sheet is completed.

Then, when said successive sheet is fed, said elapsed period is compared with said set period and if said elapsed period has not reached said set period, said successive sheet is fed after a prescribed period has passed whereby said successive sheet slidingly contacts said former sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as there is a delay of a prescribed period in the feeding operation of the successive sheet, the user does not suffer from a feeling of uneasiness. When a plurality of sheets is continuously printed, after the printing of a former sheet, in general a prescribed period passes before a successive sheet is fed; consequently the feeding operation of a successive sheet is only delayed a little, and there is very little possibility of the user feeling uncomfortable.

That is, according to the ink jet recording method of claim 13, smudging of the printed surface of already ejected sheets can be prevented without causing a feeling of uneasiness in the user in an ink jet recording method of the type wherein already printed sheets are ejected stacked one on top of the other.

According to the ink jet recording method of claim 14, multiple sheets are fed one by one towards an ink jet head and are ejected and stacked one on top of another after printing by means of the ink jet head.

Next, a period necessary for ink printed on a former sheet to be fixed enough that it does not adhere to a successive sheet stacked on top of said former sheet is set, and an elapsed period is measured from a point in time when printing up to the region of said former sheet where it slidingly contacts said successive sheet is completed.

Then, when said successive sheet is fed ,said elapsed period is compared with said set period and if said elapsed period has not reached said set period, said successive sheet is fed at a prescribed feeding speed whereby said successive sheet slidingly contacts said former sheet at a point in time when said elapsed period exceeds said set period.

Consequently, as said successive sheet slidingly contacts said former sheet at a point in time when ink printed on a former sheet is fixed enough that it does not adhere to said successive sheet stacked on top of said former sheet, there is no smudging of the printed surface of the already ejected sheet.

Next, as the successive sheet is fed at a prescribed feeding speed, the user does not suffer from a feeling of uneasiness.

That is, according to the ink jet recording method of claim 14, smudging of the printed surface of already ejected sheets can be prevented without causing a feeling of uneasiness in the user in an ink jet recording method of the type wherein already printed sheets are ejected stacked one on top of the other.

According to the ink jet recording method of claim 15, in the ink jet recording method of any one of claims 1 to 14, the temperature of the vicinity of either said ink jet head or said sheet is measured, and as said set period is set corresponding to that temperature, the set period is set appropriately.

In general, if the peripheral temperature, that is the temperature of the vicinity of either said ink jet head or said sheet is high, ink discharged onto a sheet will dry easily and therefore will fix easily; if the peripheral temperature is low, drying will be difficult therefore the ink will not fix easily. Consequently, if the peripheral temperature is high, the set period must be short, and if the peripheral temperature is low, the set period must be long.

According to the ink jet recording method of this claim 15, because the set period is set appropriately corresponding to the above-mentioned peripheral temperature, at the same time as ink printed on the former sheet is fixed to the extent that it will not adhere to a successive sheet stacked on top of the former sheet at the point in time when the successive sheet slidingly contacts the former sheet, it is possible to prevent delaying of the successive sheet other than that which is necessary, and effective printing of a plurality of sheets is possible.

According to the ink jet recording method of claim 16, in the ink jet recording method of any one of claims 1 to 15, the printing density of said former sheet is measured, and as said set period is set corresponding to that printing density, the set period is set appropriately.

In general, if the printing density, that is the volume of ink per unit of area, is low, ink discharged onto a sheet will fix easily, as it will be absorbed into the sheet easily or will dry easily and therefore; if the printing density is high, absorbing into a sheet or drying will be difficult therefore the ink will not fix easily. Consequently, if the printing density is low,the set period must be short, and if the printing density is high, the set period must be long.

According to the ink jet recording method of this claim 16, because the set period is set appropriately corresponding to the above-mentioned printing density, at the same time as ink printed on the former sheet is fixed to the extent that it will not adhere to a successive sheet stacked on top of the former sheet at the point in time when the successive sheet slidingly contacts the former sheet, it is possible to prevent delaying of the successive sheet other than that which is necessary,and effective printing of a plurality of sheets is possible.

According to the ink jet recording method of claim 17, in the ink jet recording method of claim 16, the printing density of said former sheet is measured, but as said it is measured at the location of sliding contact with said successive sheet, the set period is set even more appropriately.

Generally speaking, corresponding to the type of apparatus and sheet(stiffness etc.), the location where a successive sheet makes sliding contact with a former sheet is a constant range.

According to the ink jet recording method of this claim 17, because the measurement of the printing density of the former sheet is carried out at the location of sliding contact with the successive sheet, the set period can be set even more appropriately.

According to the ink jet recording method of claim 18, in the ink jet recording method of any one of claims 1 to 17, the length of said former sheet is measured, and as said set period is set corresponding to that length, the set period is set appropriately.

Generally speaking, if the sheet is long, the period until the successive sheet makes sliding contact with the former sheet is long; if the sheet is short, the period until the successive sheet makes sliding contact with the former sheet is short. Consequently, if the sheet is long, the set period must be short, and if the sheet is short, the set period must be long.

According to the ink jet recording method of this claim 18, because the set period is set appropriately corresponding to the length of the above-mentioned sheet, at the same time as ink printed on the former sheet is fixed to the extent that it will not adhere to a successive sheet stacked on top of the former sheet at the point in time when the successive sheet slidingly contacts the former sheet, it is possible to prevent delaying of the successive sheet other than that which is necessary, and effective printing of a plurality of sheets is possible.

According to the ink jet recording method of claim 19, as said set period is set corresponding to the material of said former sheet, the set period is set appropriately.

Generally speaking, if the sheet material is such that ink discharged onto the sheet is easily absorbed, the ink will be fixed easily on the sheet; if the sheet material is such that ink discharged onto the sheet is difficult to absorb, it will be difficult for the ink to be fixed. Consequently, if the sheet material is such that ink discharged onto the sheet is easily absorbed, the set period must be short, and if the sheet material is such that ink discharged onto the sheet is difficult to absorb, the set period must belong.

According to the ink jet recording method of this claim 19, because the set period is set appropriately corresponding to the material of the above-mentioned sheet, at the same time as ink printed on the former sheet is fixed to the extent that it will not adhere to a successive sheet stacked on top of the former sheet at the point in time when the successive sheet slidingly contacts the former sheet, it is possible to prevent delaying of the successive sheet other than that which is necessary, and effective printing of a plurality of sheets is possible.

According to the ink jet recording method of claim 20, in the ink jet recording method of any one of claims 1 to 19, as said set period is set corresponding to the type of ink discharged from said ink jet head, the set period is set appropriately.

Generally speaking, if the ink dries easily or permeates the sheet easily, the ink will be fixed easily on the sheet; if the ink does not dry easily or does not permeate the sheet easily, it will be difficult for the ink to be fixed. Consequently, if the ink dries easily or permeates the sheet easily, the set period must be short, and if the ink does not dry easily or does not permeate the sheet easily, the set period must be long.

According to the ink jet recording method of this claim 20, because the set period is set appropriately corresponding to the type of ink, at the same time as ink printed on the former sheet is fixed to the extent that it will not adhere to a successive sheet stacked on top of the former sheet at the point in time when the successive sheet slidingly contacts the former sheet, it is possible to prevent delaying of the successive sheet other than that which is necessary, and effective printing of a plurality of sheets is possible.

BRIEF DESCRIPTION OF THE DRAWINGS

FIG. 3 is a flow chart showing a first embodiment of the ink jet recording method related to the present invention.

FIG. 6 is a flow chart showing a third embodiment of the ink jet recording method related to the present invention.

FIG. 7 is a flow chart showing a fifth embodiment of the ink jet recording method related to the present invention.

FIG. 8 is a flow chart showing a ninth embodiment of the ink jet recording method related to the present invention.

FIG. 11 is a flow chart showing an eleventh embodiment of the ink jet recording method related to the present invention.

FIG. 13 is a drawing showing the flow chart of a thirteenth embodiment of the ink jet recording method related to the present invention.

DETAILED DESCRIPTION OF THE PREFERRED EMBODIMENTS

Figure 1:
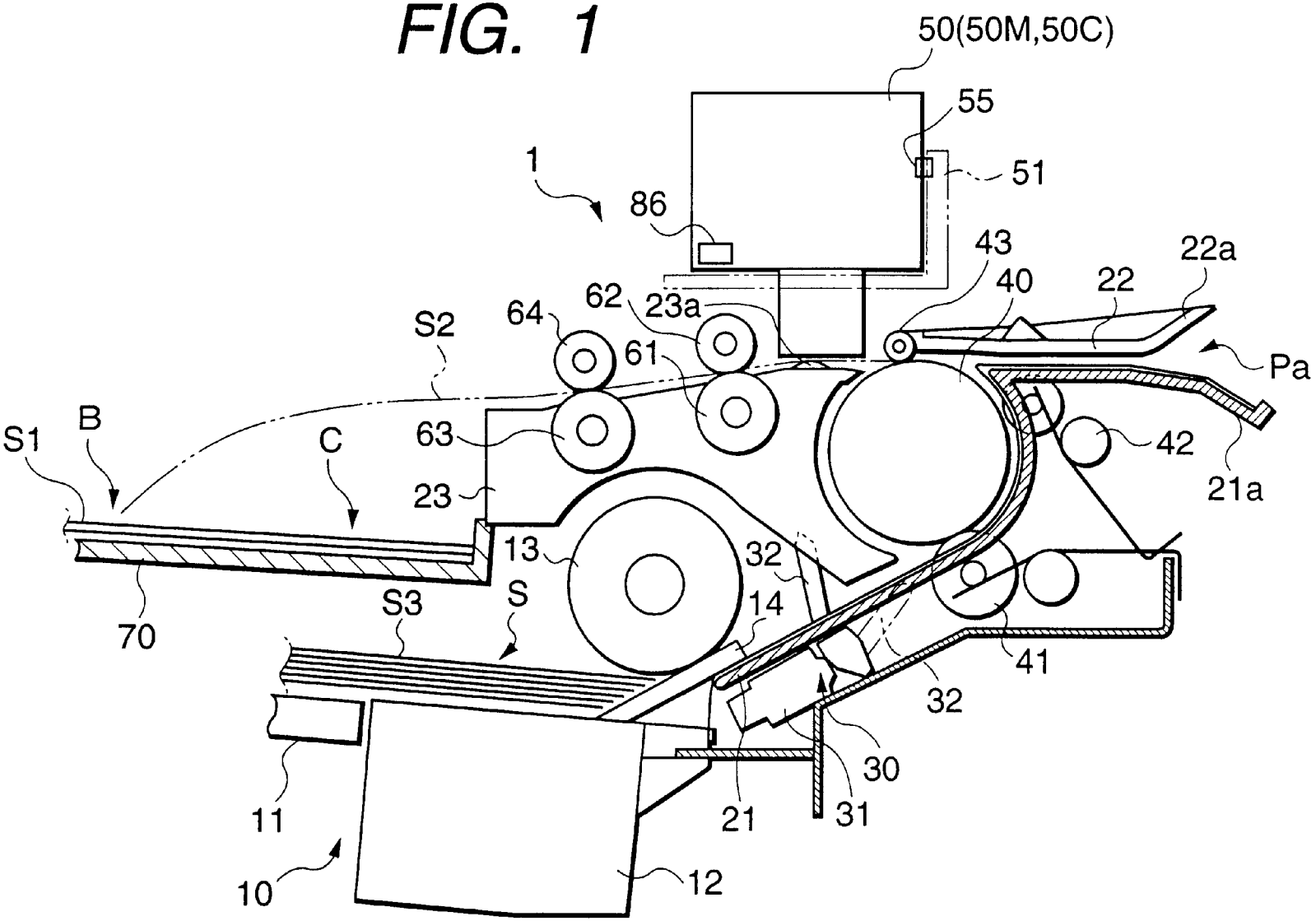
FIG. 1 is a rough structural diagram of the main components of one example of an ink jet recording apparatus to which it is possible to apply the embodiment of the ink jet recording method related to the present invention.
Figure 2:
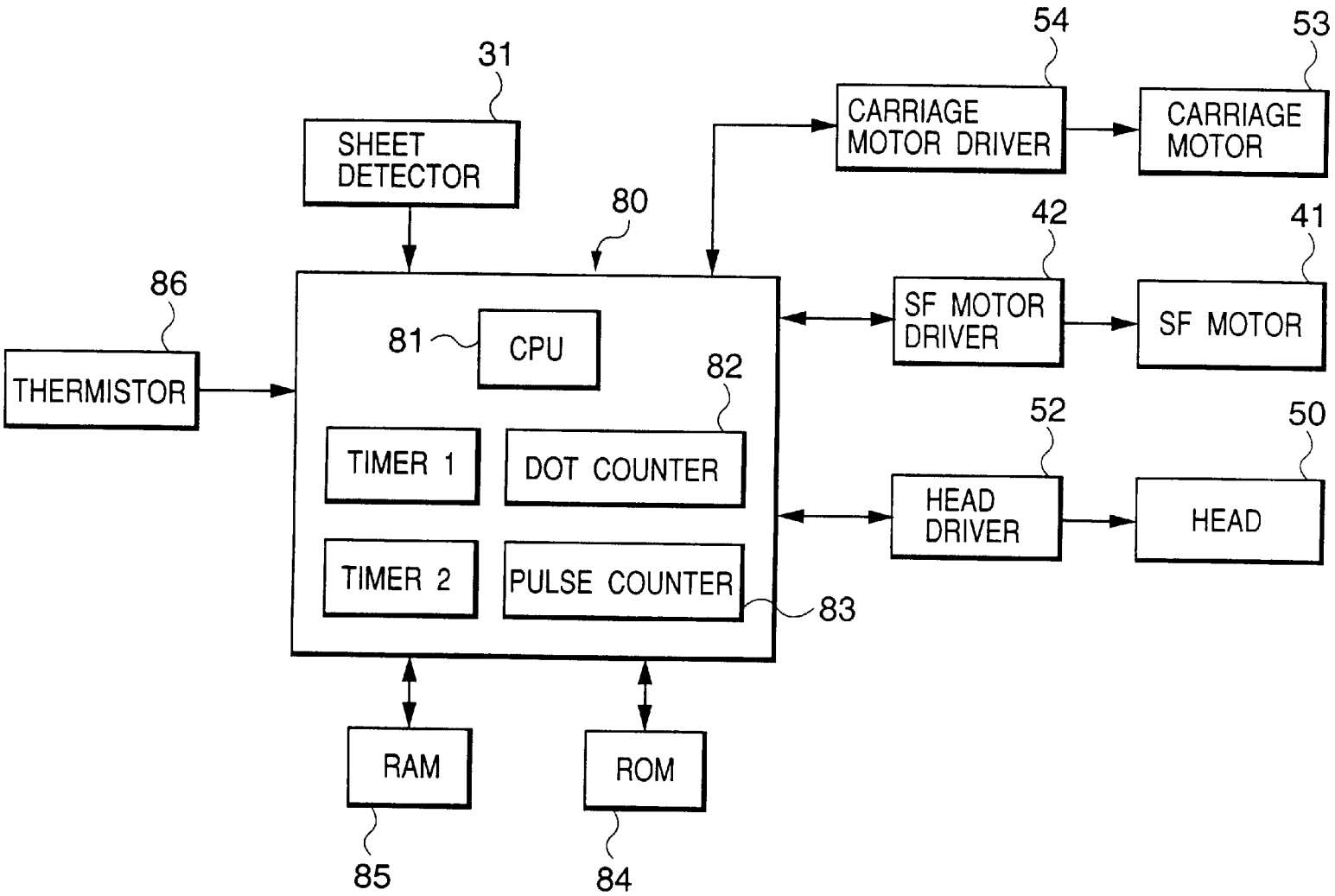
FIG. 2 is a block diagram of the main components of the above-mentioned recording apparatus.

Firstly, an example of an ink jet recording apparatus to which it is possible to apply the embodiment of the ink jet recording method related to the present invention will be explained. FIG. 1 is a rough structural diagram of the main components of one example of an ink jet recording apparatus to which it is possible to apply the embodiment of the ink jet recording method related to the present invention; and FIG. 2 is a block diagram of the main components of the above-mentioned recording apparatus.

As shown in FIG. 1, recording apparatus 1 comprises an automatic paper loading device 10, feeding sheets one at a time, and sheet guides 21, 22 and 23 guiding a sheet S2 fed by means of this automatic paper loading device 10. Furthermore, sheet detection means 30; sheet feeding roller 40; pinch rollers 41, 42 and 43 pressed against and driving sheet feeding roller 40; carriage 51—carrying an ink jet head 50 or the like—discharging ink drops towards a sheet, thereby forming ink dots and printing thereon; pairs of ejection rollers 61 and 62, 62 and 63; and an ejection tray 70 for stacking sheets S1 are provided in the path through which sheet S2 passes.

Automatic paper loading device 10 comprises a paper loading tray 11, hopper 12, paper loading roller 13, and separating pad 14. A plurality of sheets to be fed are set in paper loading tray 11. When paper is fed, hopper 12 urges sheet S1 towards paper loading roller 13, and the top sheet only is separated by separating pad 14 and fed by means of the rotation of paper loading roller 13.

Sheet detection means 30 comprises a detector 31 and a rotatably fitted lever 32 opposing it. Lever 32 pierces sheet guide 21 within the sheet conveyance path. The leading edge of a sheet fed by automatic paper loading device 10 abuts lever 32, this rotates as shown in the broken line in FIG. 1 and and switches detector 31 on, the detector stays on up to the point where the trailing edge of the sheet passes, then when the trailing edge has passed, lever 32 returns to its original position (shown by the solid line) and the detector switches off. The on/off signals from detector 31 are sent to control unit 80 (see FIG. 2). Based on these on/off signals, control unit 80 determines that there is a sheet present if the signal is on, and that there is no sheet present if the signal is off. Furthermore, when the signal changes from on to off, it determines that the trailing edge of the sheet has passed the detection means 30. That means that the trailing edge of the sheet is detected by means of the changing of the signal from on to off.

Sheet feeding roller 40 is rotatably driven by means of sheet feeding motor (SF motor) 41 shown in FIG. 2. SF motor 41 consists of a stepping motor, and the driving is controlled by means of control unit 80 via SF motor driver 42.

Ink jet head 50 (hereinafter referred to as 'head') has a large number of nozzles in a position opposing the sheet, selectively discharges ink drops from those nozzles, and from those dots forms images on sheet S2. The operation of head 50 is controlled by means of control unit 80 shown in FIG. 2 via head driver 52.

Carriage 51 is supported by means of a guide member (not shown in the drawings) capable of sliding in a direction perpendicular to the plane of view of FIG. 1. A timing belt (not shown in the drawings) is connected to the correct position in carriage 51, and by this timing belt being driven by means of carriage motor 53 (please see FIG. 2), carriage 51 moves reciprocally in a direction perpendicular to the plane of view of FIG. 1. Carriage motor 53 consists of a stepping motor, and the driving is controlled by means of control unit 80 via carriage motor driver 54.

This recording apparatus, head 50, comprises head 50M for black and white printing, and head 50C for color printing. These heads 50M and 50C are carried on carriage 51, arranged along the direction of reciprocation of the carriage. Consequently, with this recording apparatus, it is possible to carry out black and white printing by means of head 50M and to form color images by means of head 50C.

Among the pairs of ejection rollers 61 and 62, and 63 and 64, rollers 61 and 63 which touch the rear surface of sheet S2 respectively comprise rubber rollers. These rubber rollers 61 and 63 are rotatably driven by means of said SF motor 41 via a drive transmission mechanism not shown in the drawing.

Among the pairs of ejection rollers 61 and 62, and 63 and 64, rollers 62 and 64 which touch the front surface of sheet S2 respectively comprise serrated rollers (thin plate-like star wheels). These serrated rollers 62 and 64 are pressed against rubber rollers 61 and 63, and are driven by them.

In FIG. 2, 80 is the previously described control unit, connected to a host computer (for example a PC) not shown in the drawing. Control unit 80 has a central processing unit (CPU) 81, two timers (timer 1 and timer 2), a counting means (dot counter) for the number of ink drops discharged by head 50 (the number of dots) 82, and a means (pulse counter) 83 for independently counting respectively the number of pulses by which SF motor 41 is driven and the number of pulses by which carriage motor 53 is driven. When a print command and printing data from a host computer is input into CPU 81, based on this print command and printing data, each type of processing is executed according to a processing program stored in ROM 84 connected to control unit 80 (a processing program at least containing a program for implementing the ink jet recording method of the present invention), the operation of each means is controlled, and every judgement and calculation is executed.

85 is a RAM connected to control unit 80 and 86 is a temperature sensor consisting of a thermistor.

As shown in FIG. 1, thermistor 86 is fitted to carriage 51, and is capable of detecting the temperature in the vicinity of head 50. Further, as thermistor 86 is provided in one of several possible places along the sheet feed path, including the paper feed tray and the ejection tray, preferably where it can detect the peripheral temperature of the sheet.

In addition to the previously described sheet feed path, recording apparatus 1 has a second path Pa, formed by the rear portion 21*a* of sheet guide 21 and the rear portion 22*a* of sheet guide 22. This path Pa is for hand-fed paper or continuous (fan-folded) paper supplied by a tractor unit. Consequently, recording apparatus 1 has a hand-feeding port (not shown in the drawing) to the right in FIG. 1, and furthermore, atractor unit not shown in the drawing can be removably fitted.

In the above-described type of recording apparatus 1, a sheet fed by automatic paper loading device 10 is guided by sheet guide 21 and, as previously described, after sheet detection means 30 is activated, it wraps around sheet feeding roller 40 and is turned around, the feeding angle is regulated by means of pinch roller 43 and the sheet is fed out by sheet feeding roller 40. The fed out sheet S2 is guided by sheet guide 23. The ink jet head 50 and sheet S2 being regulated by means of its rear surface being guided while abutting rib 23*a* formed in the upper surface of sheet guide 23. The front surface (top surface) of sheet 52 is printed by ink discharged by head 50. When the printing data is for a plurality of lines, printing is carried out by repeatedly feeding line by line for sheet 2 by means of sheet feeding roller 40, and repetition of the printing operation by means of head 50.

Printed sheet S2 passes through pairs of ejection rollers 61 and 62 and 63 and 64, and is ejected on ejection tray 70. Ejected sheet S1 is stored stacked on ejection tray 70.

In this fashion, in an ink jet recording apparatus of the type in which an already printed sheet S1 is ejected in a stacked condition, when a plurality of sheets is continuously printed, while the ink on an already printed and ejected sheet S1 is not yet fixed, there is the problem of the next sheet S2 being ejected and slidingly contacting the printed surface of the previously ejected sheet S1 with the result that the printed surface of the previous already ejected sheet S1 is smudged.

In order to solve this kind of problem, generally speaking the method provided by this invention comprises the steps of: setting a period T necessary for ink printed on the former sheet S1 to be fixed enough that it does not adhere to a successive sheet S2 stacked on top of the former sheet S1; measuring an elapsed period tn with respect to the former sheet S1 (for example the elapsed period from a point in time when printing on former sheet S1 is completed); comparing said elapsed period tn with said set period T when said successive sheet S2 is fed (for example, when it is ejected); and if elapsed period tn has not reached set period T, feeding successive sheet S2 by a delayed operation such as an intermittent feeding operation or other means in which successive sheet S2 slidingly contacts former sheet S1 due to the ejection operation of successive sheet S2 at a point in time when elapsed period tn exceeds set period T, in such a way that the kind of problem which occurs in the conventional technology does not occur.

Next, the embodiments of the ink jet recording method of this invention will be explained in detail with reference to FIGS. 1 and 2 and various flowcharts.

Embodiment 1

FIG. 3 is a flow chart showing a first embodiment of the ink jet recording method related to the present invention. The first embodiment is an ink jet recording method wherein multiple sheets are fed to ink jet head 50 one at a time and are ejected and stacked one on top of another after printing by means of the ink jet head 50, comprising the steps of: setting a period T necessary for ink printed on the former sheet S1 to be fixed enough that it does not adhere to a successive sheet S2 stacked on top of the former sheet S1; measuring the elapsed period from a point in time when printing on former sheet S1 is completed; comparing elapsed period tn with set period T when successive sheet S2 is ejected; and if elapsed period tn has not reached set period T, ejecting successive sheet S2 by an intermittent feeding operation in which successive sheet S2 slidingly contacts former sheet S1 due to the ejecting operation of successive sheet S2 at a point in time when elapsed period tn exceeds set period T.

This will now be explained in detail with reference to the flowchart.

(1) In step ST1, a print command and printing data is input into control unit 80 from a host computer and control unit 80 operates (carries out processing) in the fashion outlined below.

(2) In step ST2, it is determined whether the printing will be monochrome (black printing) or color printing.

This determination is carried out on the basis of whether or not the print command input to the control unit 80 from the host computer contains a color printing designation. This determination can also be made according to whether or not black printing is designated in head driver 52. Further, in the above-mentioned recording apparatus 1, head 50M for black and white printing, and head 50C for color printing are mounted on carriage 51—arranged along the direction of reciprocation of the carriage—but a construction wherein either head 50M for black and white printing or head 50C for color printing are mounted on carriage 51 is also possible, and in this case as shown in FIG. 1, an identifying terminal 55 is provided in carriage 51 connected to either head 50M or head 50C, and the determination can be made according to the connection pattern of this terminal 55; that is, according to whether head 50M for black and white printing or head 50C for color printing is mounted as head 50. When it is determined in step ST2 that color printing—that is, not monochrome (black) printing—is to be carried out, a normal operation, namely a normal feeding operation, is carried out in step ST3, the color printing operation is carried out and after the ejection operation, the process returns to the start.

In this embodiment, when color printing is carried out, so-called super penetrating ink—that is, ink which fixes easily on a sheet—is used; when monochrome printing is carried out, so-called low penetrant ink—that is, ink which fixes with difficulty on a sheet—is used. Consequently, step ST2 indirectly determines the type of ink, and in the case of color printing as the ink fixes easily, the above-described delaying operation is not implemented. However, if an ink which fixes with relative difficulty is used during color printing, it is possible to utilize the delaying operation described above.

On the other hand, if it is determined in step ST2 that monochrome (black) printing is to be carried out, the process continues to step ST4.

(3) In step ST4, it is determined whether the sheet feeding operation must be carried out by means of paper feed roller 13 (Friction) or by a tractor unit (Tractor).

This determination is carried out on the basis of whether or not the print command input to the control unit 80 from the host computer designates sheet feeding by means of paper feed roller 13—that is, automatic paper feeding device 10—or continuous paper feeding by the tractor unit.

When it is determined that sheet feeding must be carried out by means of the tractor unit, a normal operation—namely a normal operation of continuous paper feeding by the tractor unit—is carried out in step ST5, the printing operation is carried out and after the ejection operation, the process returns to the start.

On the other hand, if it is determined that sheet feeding must be carried out by means of paper feed roller 13, the process continues to step ST6.

(4) In step ST6, it is determined whether elapsed period tn has reached set period T or is in the condition tn=0.

Elapsed period tn is the period which has elapsed from the point in time when printing of former sheet S1 finished.

Set period T is the period necessary for ink printed on a former sheet S1 to be fixed enough that it does not adhere to a successive sheet S2 stacked on top of the former sheet S1, and it is set as described above.

Now, the power source for recording apparatus 1 is switched on. In the above-mentioned step ST1, a print command is input. When a first sheet is fed to be printed, as there is no former sheet with respect to this first sheet, the condition tn=0 is always determined in step ST6.

In step ST7, when the condition tn=0 is determined in step ST6, control unit 80 detects temperature S by means of thermistor 86.

Next, timers 1 and 2 are reset in step ST8 and the sheet is fed and printed in step ST9.

After that, a printing completed signal is output in step ST10 and in step ST11, one of the timers (for example, timer 1) is activated and measurement of elapsed period t1 (the first tn) begins.

Then, in step ST12, the sheet is ejected and the process returns to the start.

With regard to the second sheet onward, as there is always a former sheet S1 (for example, the first sheet in the case of a second sheet, or the second sheet in the case of a third sheet), there is no possibility of tn=0 being determined in step ST6, and so whether or not elapsed period tn has reached set period T—, that is, whether or not tn>T—is determined.

Here, set period T is set in the following way. A table of values for set period T corresponding to temperature S (such as that shown in FIG. 4 for example) is stored in ROM 84, and detected temperature S is recorded in RAM 85 in the above-described step ST7 (or step ST14, described later). Set period T is set corresponding to this temperature S. For example, if temperature S is 18 deg. C, set period T is set at 32 seconds. Furthermore, set period T is set assuming that the printing density is relatively high.

If tn>T. as the period necessary for ink printed on a former sheet S1 to be fixed enough that it does not adhere to a successive sheet S2 (here, the same sheet as in the determination of step ST6) stacked on top of the former sheet S1 has passed, processing is carried out according to steps ST7 to ST12 described above. Additionally, in this case, the temperature S detected in step ST7 is overwritten (the data previously recorded in the RAM is overwritten) in order to set the set period T with respect to the next sheet.

If the condition is not tn>T, as the period necessary for ink printed on a former sheet S1 to be fixed enough that it does not adhere to a successive sheet S2 (here, the sheet presented for determination in step ST6) stacked on top of the former sheet S1 has not yet passed, the process continues from step ST13 below onward. Moreover, in this case, the timer which measures elapsed period tn continues to measure the elapsed period until being reset in step ST28 which is described later.

(5) Sheet feeding is carried out in step ST13, and in step ST14, temperature S is detected. The temperature S detected in this step ST14 replaces the previously recorded temperature and is recorded in the RAM in order to set the set period T with respect to the next sheet.

(6) In step ST15 the type of sheet is determined.

This determination is carried out on the basis of a paper designation included in the print command input to the control unit 80 from the host computer. Designation of the paper (sheet) is done by the user. Furthermore, the discrimination between different types of paper may also be carried out according to—for example—the result of detection of the sheet length by counting the number of rotations of sheet feeding roller 40 (the number of steps of SF motor 41) between on/off detection in the processes of the above-mentioned steps ST8 to ST12.

If the sheet is not a postcard, OHP sheet or envelope etc., if it is for example an normal type of paper or coated paper, a normal printing operation is carried out in step ST16, that is the sheet is fed line by line by sheet feeding roller 40 and printing is carried out until all the print data is finished, and the process proceeds to step ST20.

On the other hand, if the sheet is a postcard, OHP sheet or envelope etc., after printing one line in step ST17, the sheet feeding operation is halted for only 2 seconds in step ST18, and in step ST19, after repeating steps 17 and 18 until all the printing data is finished, the process proceeds to step ST20. When the type of sheet is a postcard etc., in general either the printing region of the postcard etc. is narrow, or it is difficult for the ink to fix (in the case of OHP sheets the printing region is not especially narrow, but it is difficult for the ink to fix), and if a normal printing operation is carried out, the standby period T1 becomes rather too long at the time of intermittent feeding (described later). Therefore, in order to avoid this, the sheet feeding operation is halted for 2 seconds for every line of printing.

(7) In step ST20 a printing completed signal is detected and in step ST21 the other timer (for example timer 2) is activated and measurement of the elapsed period t (n+1) begins. This elapsed period t (n+1) is for carrying out the determination in step ST6 with respect to the next sheet (S3 in FIG. 1)—that is, it is tn with respect to the next sheet.

(8) In step ST22, it is determined again whether or not elapsed period tn has reached set period T.

If tn>T, as the period necessary for ink printed on a former sheet S1 to be fixed enough that it does not adhere to a successive sheet S2 (here, the sheet presented for determination in step ST22) stacked on top of the former sheet S1 has passed, in step ST23, the timer which counts tn (in this case timer 1) is reset, and after the sheet is ejected by means of a normal ejection operation (not intermittently, a relatively high speed ejection operation), the process returns to the start.

If the condition is not tn>T, as the period necessary for ink printed on a former sheet S1 to be fixed enough that it does not adhere to a successive sheet S2 stacked on top of the former sheet S1 has not yet passed, the process continues from step ST24 below onward.

(9) In step ST24, whether or not sheet detection means 30 has detected a sheet—that is, whether or not the trailing edge of the sheet has passed lever 32 of sheet detection means 30—is determined.

If the trailing edge of the sheet has not yet passed lever 32 of sheet detection means 30, a normal intermittent feeding operation (line by line feeding) is carried out in step ST25 up to when the trailing edge of the sheet passes lever 32.

In step ST24, if the trailing edge of the sheet has already passed lever 32, or it is determined that it has passed, the process proceeds to step ST26.

(10) In step ST26, the distance from the trailing edge of the sheet to the pair of ejection rollers 63 and 64 is calculated, and based on this value L, the number of times of intermittent feeding N described later (executed in step ST29) is found using the following equation:

$$L=(1/6)\ \text{in.}\times N.$$

Furthermore, (1/6) in. is the amount fed at one time (1 pitch) during intermittent feeding.

Distance L is found by the following equation:

$$L=(P1-P2)\times L1$$

where fixed value P1 is the number of steps of SF motor 41 from when the trailing edge of the sheet is detected by sheet detection means 30 to when it passes the pair of sheet ejection rollers 63 and 64; P2 is the number of steps of SF motor 41 from when the trailing edge of the sheet is detected by sheet detection means 30 up to the time step ST26 is executed; and L1 is the length of sheet fed by one step of SF motor 41.

(11) In step ST27, the interval time (pitch interval period= standby period) T1 (seconds) of intermittent feeding (described later) is found using the following equation:

$$T1=(T-tn)/N-0.1.$$

Furthermore, 0.1 (seconds) is given in the equation because a period of 0.1 seconds is necessary in order to feed the sheet by 1 pitch.

(12) In step ST28, the timer which counted tn (for example timer 1) is reset.

(13) In step ST29, the sheet is ejected by intermittent feeding N times, by interval period T and pitch feeding amount (1/6)", and then the process returns to the start.

The following functional effects are obtained in accordance with the kind of ink jet recording method described above.

Multiple sheets are fed to an ink jet head 50 one at a time and are ejected and stacked one on top of another after printing by means of the ink jet head 50.

Then, a period T necessary for ink printed on the former sheet S1 to be fixed enough that it does not adhere to a successive sheet S2 stacked on top of the former sheet S1 is set and the elapsed period from a point in time when printing on former sheet S1 is completed is measured by means of step ST11 or ST21.

Next, when successive sheet S2 is ejected, in step ST22 elapsed period tn is compared with set period T; and if elapsed period tn has not reached set period T, in steps 26 to 29, successive sheet S2 is ejected by an intermittent feeding operation in which successive sheet S2 slidingly contacts former sheet S1 due to the ejecting operation of successive sheet S2 at a point in time when elapsed period tn exceeds set period T.

Consequently, as said successive sheet S2 slidingly contacts said former sheet S1 at a point in time when ink printed on former sheet S1 is fixed enough that it does not adhere to successive sheet S2 stacked on top of former sheet S1, there is no smudging of the printed surface of the already ejected sheet.

Next, as successive sheet S2 is ejected by means of the intermittent feeding operation of step ST29, the user does not suffer from any uncomfortable feeling. Furthermore, in step ST18, sheet feeding is halted only for 2 seconds: this halting is during the printing operation, however because the halt is very brief the user does not suffer from any uncomfortable feeling.

That is, according to this ink jet recording apparatus, in an ink jet recording method wherein already printed sheets are ejected and stacked one on top of another, it is possible to prevent smudging of the printed surface of an already ejected sheet, without creating anxiety on the part of the user.

Figures 4, 5:
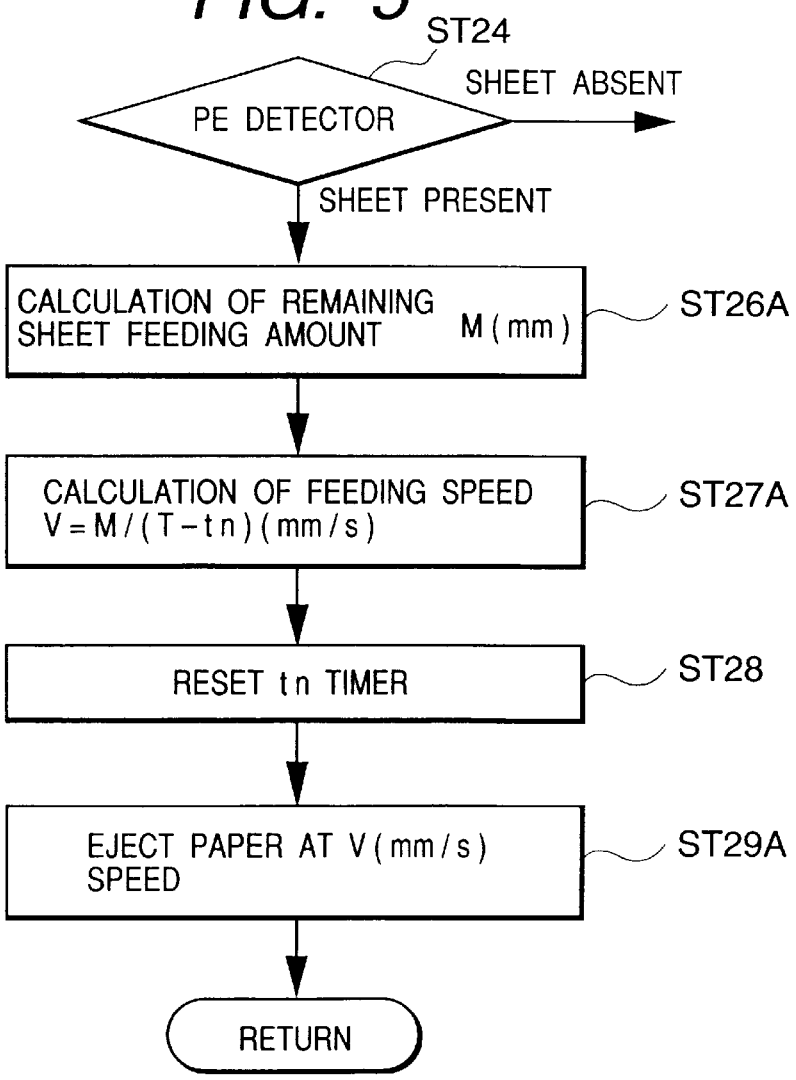
FIG. 4 is a drawing showing one example of a set period.
FIG. 5 is a drawing showing the main components of a flowchart of a second embodiment of the ink jet recording method related to the present invention.

Moreover, in either step ST7 or ST14, the temperature of the vicinity of ink jet head 50 is measured, and as shown in FIG. 4, a set period T is set corresponding to this temperature, set period T is set appropriately. Furthermore, this is the same when thermistor 86 is provided at an optional position within the sheet feed path, including the paper feed tray and paper ejection tray, and the temperature of the vicinity of the sheet is detected.

In general, if the peripheral temperature, that is the temperature of the vicinity of either said ink jet head or said sheet is high, ink discharged onto a sheet will dry easily and therefore will fix easily; if the peripheral temperature is low, drying will be difficult therefore the ink will not fix easily. Consequently, if the peripheral temperature is high, the set period must be short, and if the peripheral temperature is low, the set period must be long.

According to this ink jet recording method, because the set period T is set appropriately corresponding to the above-mentioned peripheral temperature, at the same time as ink printed on former sheet S1 is fixed to the extent that it will not adhere to successive sheet S2 stacked on top of former sheet S1 at the point in time when successive sheet S2 slidingly contacts former sheet S1, it is possible to prevent delaying of successive sheet S2 other than that which is necessary, and effective printing of a plurality of sheets is possible.

Embodiment 2

FIG. 5 is a drawing showing the main components of a flowchart of a second embodiment of the ink jet recording method related to the present invention.

The point of difference between this second embodiment and the above-described first embodiment is that successive sheet S2 is not ejected by means of an intermittent feeding operation, but is ejected at a prescribed ejection speed V whereby successive sheet S2 slidingly contacts former sheet S1 due to the ejection operation of successive sheet S2 at a point in time when elapsed period tn exceeds set period T. The other points remain unchanged.

In embodiment 2, in step ST26A, the distance M from the trailing edge of the sheet to the pair of ejection rollers 63 and 64 (remaining sheet feeding amount) is calculated. Distance M is found in the same way as the previously described distance L by the following equation:

$$M=(P1-P2)\times M1$$

where fixed value P1 is the number of steps of SF motor 41 from when the trailing edge of the sheet is detected by sheet detection means 30 to when it passes the pair of sheet ejection rollers 63 and 64; P2 is the number of steps of SF motor 41 from when the trailing edge of the sheet is detected by sheet detection means 30 up to the time step ST26 is executed; and M1 is the length of sheet fed by one step of SF motor 41.

Next, in step ST27A, the sheet feeding speed V (mm/s) is found using the following equation:

$$V=M/(T-tn).$$

After that, in step ST28, the timer which counted tn (for example timer 1) is reset.

Then, in step ST29A, the sheet is ejected at the above-mentioned speed V, and then the process returns to the start.

According to the second embodiment, before said successive sheet is ejected , elapsed period tn is compared with set period T (step ST22 in FIG. 3), and if elapsed period tn has not reached set period T, in steps ST26A to ST29A, successive sheet S2 is ejected at a prescribed ejection speed V whereby successive sheet S2 slidingly contacts former sheet S1 due to the ejection operation of successive sheet S2 at a point in time when elapsed period tn exceeds set period T.

Consequently, as successive sheet S2 slidingly contacts former sheet S1 at a point in time when ink printed on former sheet S1 is fixed enough that it does not adhere to successive sheet S2 stacked on top of former sheet S1, there is no smudging of the printed surface of the already ejected sheet S1.

Next, as the successive sheet S2 is ejected at a prescribed feeding speed in step ST29A, the user does not suffer from a feeling of uneasiness.

That is, according to this ink jet recording method, smudging of the printed surface of already ejected sheets can be prevented without causing a feeling of uneasiness in the user in an ink jet recording method of the type wherein already printed sheets are ejected and stacked one on top of the other.

Moreover, the other functional effects are the same as those of the first embodiment described above.

Embodiment 3

FIG. 6 is a flow chart showing a third embodiment of the ink jet recording method related to the present invention. In this drawing, the steps which are the same as those in the flowchart shown in FIG. 3 are given the same step numbers.

The point of difference between this third embodiment and the above-described first embodiment is that the elapsed period is not measured from the point in time when successive sheet S2 is ejected; the trailing edge of successive sheet S2 is detected, and the elapsed period is measured from the point in time when the trailing edge is detected. The other points remain unchanged.

That is, the characteristics of this embodiment are that step ST10 shown in FIG. 3 is replaced by steps ST10A and ST10B shown in FIG. 6; step ST20 shown in FIG. 3 is replaced by steps ST20A and ST20B shown in FIG. 6; and steps ST24 and ST25 shown in FIG. 3 are removed.

In this third embodiment, after printing is completed, in the previously mentioned steps ST20A (or ST10A), at the point in time when the trailing edge of the sheet has already passed lever 32 (or it has been determined to have done so), measurement of the elapsed period t (n+1) or t1 for the delaying process of the successive sheet begins.

According to the third embodiment, when the successive sheet is ejected , elapsed period tn is compared with set period T (step ST22 in FIG. 6), and if elapsed period tn has not reached set period T, in steps ST26 to ST29, successive sheet S2 is ejected by means of an intermittent feeding operation at an interval T1 in which the successive sheet slidingly contacts the former sheet due to the ejection operation of the successive sheet at a point in time when elapsed period tn exceeds set period T.

Next, as the measurement of said elapsed period tn is carried out from the point in time when the trailing edge of the former sheet S1 is detected, it is possible to prevent smudging of the printed surface of already ejected sheets more reliably. This is because when measurement of the elapsed period is carried out from the point in time when printing of the former sheet has been completed, as it is not necessarily easy to determine when the printing is completed, it is possible to carry out measurement more reliably from when the trailing edge of the fomer sheet is detected by the sheet detection means 30.

Moreover, the other functional effects are the same as those of the first embodiment described above.

Embodiment 4

The point of difference between this third embodiment and the above-described third embodiment is that the successive sheet S2 is not ejected by means of an intermittent feeding operation, but is ejected at a prescribed ejection speed V whereby said successive sheet slidingly contacts said former sheet due to the ejection operation of said successive sheet at a point in time when said elapsed period tn exceeds said set period T. The other points remain unchanged.

That is, the characteristic of this embodiment is that steps ST26 to ST29 in the flowchart shown in FIG. 6 are replaced by steps ST26A to ST29A shown in FIG. 5.

According to this fourth embodiment also, as the measurement of said elapsed period tn is carried out from the point in time when the trailing edge of the former sheet S1 is detected, it is possible to prevent smudging of the printed surface of already ejected sheets more reliably. Moreover, the other functional effects are the same as those of the third embodiment described above.

Embodiment 5

FIG. 7 is a flow chart showing a fifth embodiment of the ink jet recording method related to the present invention. In this drawing, the steps which are the same as those in the flowchart shown in FIG. 3 are given the same step numbers. Moreover, this fifth embodiment corresponds to the invention described in claim 7.

The point of difference between this fifth embodiment and the above-described first embodiment (FIG. 3) is that the elapsed period tn is not compared with the set period T at the point in time when printing of the former sheet has been completed; elapsed period tn is compared with set period T at the point in time when a prescribed amount of successive sheet S2 has been fed. The other points remain unchanged.

That is, the characteristic of this embodiment is that steps ST16 to ST20 in the flowchart shown in FIG. 3 are replaced by steps ST16C to ST20C shown in FIG. 7. The changed portions are explained below.

(1) Regardless of the type of sheet, one line is printed by step ST16C or ST17C. Furthermore, when the sheet is a type such as a postcard or the like, sheet feeding is halted for 2 seconds in step ST18C as in the first embodiment.

(2) In step ST19C1, it is determined whether or not a prescribed amount of the sheet has been fed. This determination can be carried out by means of counting the number of steps N1 of SF motor 41 which feeds successive sheet S2, and comparing that number with the number of steps N2 of SF motor 41 corresponding to the prescribed amount of sheet feeding (for example, 250 mm) which is decided in advance.

If N1>N2, that is, if it has been determined that the prescribed amount has been fed, the process proceeds to step ST19C3.

If N1>N2, that is, if it has been determined that the prescribed amount has not been fed, in step ST19C2 it is determined whether there is any printing data or not; if there is printing data, the process returns to step ST15 and printing is repeated; if it is determined that there is no printing data, the process proceeds to step ST19C3.

(3) In step ST19C3, elapsed period tn is compared with set period T.

If tn>T, as a period necessary for ink printed on former sheet S1 to be fixed enough that it does not adhere to successive sheet S2 ( the sheet which is presently being determined in step ST19C3) stacked on top of former sheet S1 has passed, whether there is any printing data or not is determined in step ST19C2. Then, after printing is carried out in step ST19C5 if there is any printing data, or in the same condition if there is no printing data, the timer which counted tn (for example timer 1) is reset in step ST19C6, measurement of elapsed period t (n+1) for the next sheet is begun in step ST19C7, and after the sheet is ejected by means of an normal ejection operation in step ST19C8, the process returns to the start.

If the condition is not tn>T, as a period necessary for ink printed on former sheet S1 to be fixed enough that it does not adhere to successive sheet S2 stacked on top of former sheet S1 has not yet passed, whether there is any printing data or not is determined in step ST20C. Then, if there is any printing data printing is repeated in step ST15, or in the same condition if there is no printing data, the process proceeds to step ST21.

The explanation of steps ST21 onwards is the same as in the first embodiment.

According to this fifth embodiment, if elapsed period tn has already reached set period T at the point in time when successive sheet S2 has been fed a prescribed amount, as it is possible to quickly eject sheet S2 (particularly when there is no printing data after—please refer to step ST19C4), the sheet can be effectively ejected.

Moreover, the other functional effects are the same as those of the first embodiment described above.

Embodiment 6

The point of difference between this sixth embodiment and the above-described third embodiment is that the successive sheet S2 is not ejected by means of an intermittent feeding operation, but is ejected at a prescribed ejection speed V whereby said successive sheet slidingly contacts said former sheet due to the ejection operation of said successive sheet at a point in time when said elapsed period tn exceeds said set period T. The other points remain unchanged.

That is, the characteristic of this embodiment is that steps ST26 to ST29 in the flowchart shown in FIG. 6 are replaced by steps ST26A to ST29A shown in FIG. 5.

According to this sixth embodiment, the same functional effect as the above-described fifth embodiment can be obtained.

Embodiment 7

This seventh embodiment corresponds to the invention described in claim 9.

The point of difference between this seventh embodiment and the above-described fifth embodiment (FIG. 7), is that the elapsed period is not measured from the point in time when successive sheet S2 is ejected; the trailing edge of successive sheet S2 is detected, and the elapsed period is measured from the point in time when the trailing edge is detected. The other points remain unchanged.

That is, this seventh embodiment is a combination of the previously mentioned third embodiment (FIG. 6) and fifth embodiment (FIG. 7), and it is realized in the following manner.

(a) Step ST10 in the flowchart shown in FIG. 7 is replaced by steps ST10A to ST10B shown in FIG. 6.

(b) Steps ST20A to ST20B shown in FIG. 6 are inserted between either steps ST19C4 and ST19C6 or steps ST19C6 and ST19C7 in the flowchart shown in FIG. 7.

(c) Steps ST20A to ST20B shown in FIG. 6 are inserted between steps ST20C and ST21 in the flowchart shown in FIG. 7.

(d) Steps ST24 to ST25 in the flowchart shown in FIG. 7 are removed.

According to this seventh embodiment, a combination of the functional effects of the third embodiment and the fuctional effects of the fifth embodiment is obtained; that is, it is possible to prevent smudging of the printed surface of already ejected sheets more reliably and the sheet can be effectively ejected.

Moreover, the other functional effects are the same as those of the first embodiment described above.

Embodiment 8

The point of difference between this eighth embodiment and the above-described seventh embodiment is that the successive sheet S2 is not ejected by means of an intermittent feeding operation, but is ejected at a prescribed ejection speed V whereby said successive sheet slidingly contacts said former sheet due to the ejection operation of said successive sheet at a point in time when said elapsed period tn exceeds said set period T. The other points remain unchanged.

That is, the characteristic of this embodiment is that steps ST26 to ST29 in the seventh embodiment are replaced by steps ST26A to ST29A shown in FIG. 5.

According to this eighth embodiment, the same functional effect as the above-described seventh embodiment can be obtained.

Embodiment 9

FIG. 8 is a flow chart showing a ninth embodiment of the ink jet recording method related to the present invention. In this drawing, the steps which are the same as those in the flowchart shown in FIG. 3 are given the same step numbers. Moreover, this ninth embodiment corresponds to the invention described in claim 11.

The point of difference between this ninth embodiment and the previously-described first embodiment is that the elapsed period is not measured from the point in time when printing of the former sheet is completely finished; the measurement of said elapsed period is carried out from the point in time when printing up to the region of the former sheet where it slidingly contacts said successive sheet is completed.

Generally speaking, the region where the successive sheet slidingly contacts the former sheet is somewhat limited. Consequently, it is important whether or not the ink is fixed in this region.

Figures 9, 10:
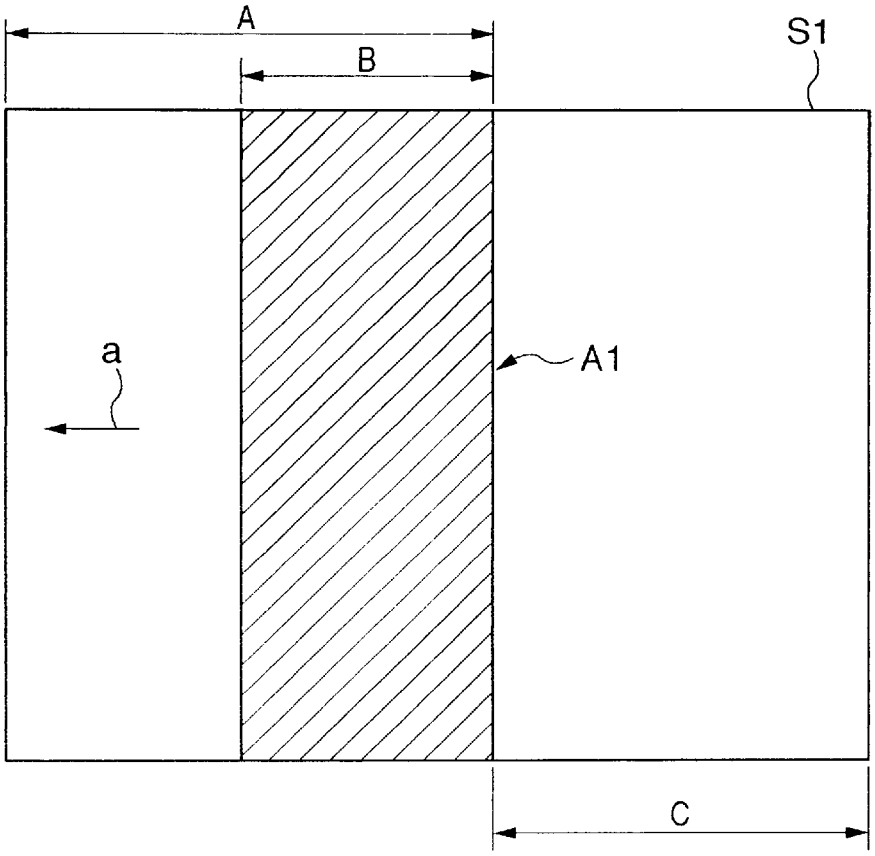
FIG. 9 is a plan view of a sheet.
FIG. 10 is a drawing showing one example of the number of prescribed steps according to the sheet size.

This point will be explained referring to FIG. 1 and FIG. 9. FIG. 9 is a plan view of the former sheet.

As shown in FIG. 1, when a successive sheet S2 is ejected onto a former sheet S1 already ejected into ejection tray 70, successive sheet S2 touches former sheet S1 at portion B and by being ejected, slidingly contacts and moves from this portion B to the left of FIG. 1.

As portion B where the sliding contact begins differs according to the bending of successive sheet S2 due to the stiffness of the sheet and the printing density (moisture content), in reality as shown in FIG. 9, sliding contact begins in region B and this sliding contact follows arrow A.

That is, region A in former sheet S1 in FIG. 9 is a region of sliding contact with successive sheet S2, and it is important whether or not the ink is fixed in this region.

The characteristic of this ninth embodiment, based on these circumstances, is as described above; the measurement of said elapsed period is carried out from the point in time when printing of the region of the former sheet where it slidingly contacts said successive sheet is completed—to be exact steps ST16 to ST21 in the flowchart shown in FIG. 3 are replaced by steps ST16D to ST21D3 shown in FIG. 8. The portions which are changed are explained below.

(1) One line is printed regardless of the type of sheet by step ST16D or step ST17. Furthermore, when the sheet is a postcard or such like, the point of halting sheet feeding for 2 seconds in step ST18 is the same as the first embodiment.

(2) In steps ST19D and ST20D, it is determined whether or not printing of the region of sliding contact A between the successive sheet (sheet S3 in FIG. 1) and the former sheet (in this case the sheet which was printed in steps ST16D or ST17) is completed.

Namely, in step ST19D, it is determined whether region A of the sheet has passed the region printed by head 50.

This determination is carried out by counting the number of steps P3 of SF motor 41 and determining whether or not this number exceeds a prescribed number of steps P4 (P3>P4). Further, if the sheet size is different, for example as shown in FIG. 10 as region A is also different, it is necessary to change the prescribed number of steps P4. Here, in this embodiment this is not shown in the drawings, but in the processes where a first sheet is fed, printed and ejected—that is, in the processes in steps ST9 to ST12, the sheet size is determined by counting the number of steps of SF motor 41 from when sheet detection means 30 is switched on by the trailing edge of the sheet to when sheet detection means 30 is switched off by the trailing edge of the sheet passing; and corresponding to this a prescribed number of steps P4 (Pa to Pf in FIG. 10) is selected.

When it is determined in step ST19D that region A of the sheet has passed the region printed by head 50, the process proceeds to step ST21D1.

When it is determined in step ST19D that region A of the sheet has not yet passed the region printed by head 50, the process proceeds to step ST20D.

In step ST20D, it is determined whether or not there is any printing data; if there is printing data, steps ST15 to ST19D are repeated, if there is no printing data, the process proceeds to step ST21D1.

Namely, if region A of the sheet has passed the region printed by head 50, or even if it has not passed if there is no printing data, the process proceeds to step ST21D1.

(3) In step ST21D1, measurement of an elapsed period t (n+1) for the next sheet is started. Further, even if region A of the sheet has passed the region printed by head 50, if there is no printing data, in step ST21D1 measurement of an elapsed period t (n+1) for the next sheet is started, but in this case, as ink has not been discharged at least in the trailing portion A1 of region A, even if processing is carried out in the same way as when region A has passed no inconvenience occurs.

(4) In step ST21D2, it is determined whether or not there is any printing data, that is whether or not there is any data which must be printed in region C shown in FIG. 9.

If there is printing data, after carrying out all the printing in step ST21D3, the process proceeds to step ST22. Steps 22 onward are the same as the first embodiment (FIG. 3).

According to this ninth embodiment, as the measurement of said elapsed period tn is carried out from the point in time when printing of the region A of the former sheet where it slidingly contacts said successive sheet is completed, there is no unnecessary delay in ejecting the successive sheet, and ejection can be carried out effectively.

Moreover, the other functional effects are the same as those of the first embodiment described above.

Furthermore, if the same kind of processing as in steps ST13 to ST21D3 is substituted for steps ST9 to ST11 as shown in the flowchart in FIG. 8 (in this case, proceeding to step ST12 if it is determined that there is no printing data in step ST21D2) as this results in the possibility of effective ejection, this is even further advantageous.

Embodiment 10

The point of difference between this tenth embodiment and the above-described ninth embodiment is that the successive sheet S2 is not ejected by means of an intermittent feeding operation, but is ejected at a prescribed ejection speed V whereby said successive sheet slidingly contacts said former sheet at a point in time when said elapsed period tn exceeds said set period T. The other points remain unchanged.

That is, the characteristic of this tenth embodiment is that steps ST26 to ST29 in the flowchart shown in FIG. 8 are replaced by steps ST26A to ST29A shown in FIG. 5.

According to this tenth embodiment, the same functional effect as the above-described ninth embodiment can be obtained.

Embodiment 11

FIG. 11 is a flow chart showing an embodiment of the ink jet recording method related to the invention of claim 13. In this drawing, the steps which are the same as those in the flowchart shown in FIG. 8 are given the same step numbers.

The point of difference between this embodiment and the previously-described ninth embodiment (FIG. 8) is that there is no delay when the successive sheet is ejected; rather, the delay is at the time of feeding the sheet. The other points remain unchanged. Now, the flowchart of FIG. 11 is explained below.

(1) Steps ST1 to ST5 are the same as the previous embodiment.

(2) In step ST4, if it is determined that a sheet feeding operation must be carried out by feed roller 13, the peripheral temperature S of ink jet head 50 is measured in step ST4E.

(3) In step ST6, a set period T is set corresponding to the above mentioned temperature S, and it is determined whether or not elapsed period tn has reached set period T, or elapsed period tn is in the condition tn=0. Furthermore, taking into account the time necessary for the printing operation performed after the paper feeding operation, the set period T here is set shorter (for example, one half the period) than the set periods shown in FIG. 4. Yet further, elapsed period tn is the period which elapses from the point in time when printing of the region of sliding contact A between former sheet S1 and successive sheet S2 is completed.

(4) If the condition tn=0 (that is, it is the first sheet) or tn>T is determined in step ST6, all timers are reset in step ST8, and after carrying out a normal feeding operation in step ST8E, the process proceeds to step ST15.

(5) If the condition tn>T is not determined in step ST6, a waiting period (delay period) T2 (T2=T−tn) is calculated in step ST7E, and after that, the tn timer is rest in step ST7E1.

(6) In step ST9E, after period T2 has passed, sheet feeding is carried out and the process proceeds to step ST15.

(7) Steps ST15 to ST21D3 are the same as in the ninth embodiment (FIG. 8).

(8) After it is determined that there is no printing data in step ST21D2, a normal ejection operation is carried out and the process returns to the start.

According to an embodiment of the type described above, when a successive sheet S2 is fed, elapsed period tn and set period T are compared, if elapsed period tn has not yet reached set period T, successive sheet S2 is fed after a prescribed period T2 has elapsed whereby said successive sheet S2 slidingly contacts said former sheet S1 at a point in time when said elapsed period tn exceeds said set period T.

Consequently, as successive sheet S2 slidingly contacts former sheet S1 in portion B (please see FIG. 9) at appoint in time when ink printed on former sheet S1 is fixed enough that it does not adhere to successive sheet S2 stacked on top of former sheet S1, there is no smudging of the printed surface of the already ejected sheet S1.

Next, as there is a delay of only prescribed period T2 in the feeding operation of the successive sheet S2, the user does not suffer from a feeling of uneasiness. When a plurality of sheets is continuously printed, after the printing of a former sheet, in general the prescribed period passes before a successive sheet is fed; consequently even if the feeding operation of a successive sheet is a little delayed, there is very little possibility of the user feeling uncomfortable That is, according to this ink jet recording method, smudging of the printed surface of already ejected sheets can be prevented without causing a feeling of uneasiness in the user in an ink jet recording method of the type wherein already printed sheets are ejected and stacked one on top of the other.

Moreover, as said elapsed period tn elapsed period is measured from a point in time when printing up to the region A of former sheet S1 where it slidingly contacts said successive sheet S2 is completed, feeding of a successive sheet is not unnecessarily delayed, and effective feeding is possible.

Embodiment 12

Figures 12, 14:
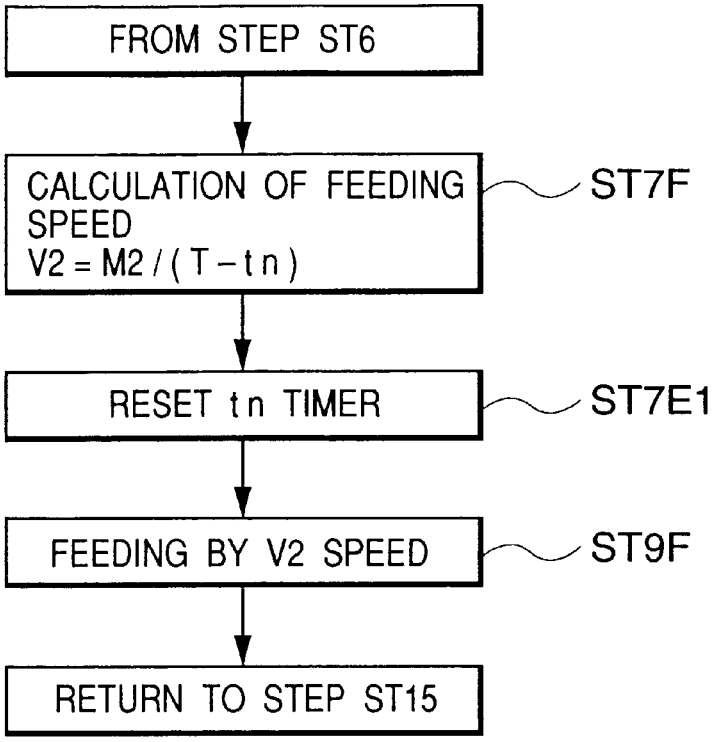
FIG. 12 is a drawing showing the main components of a flowchart of an embodiment of the ink jet recording method related to the invention of claim 14.
FIG. 14 is one example of factors corresponding to printing density.

FIG. 12 is a drawing showing the main components of a flowchart of an embodiment of the ink jet recording method related to the invention of claim 14.

The point of difference between this embodiment and the above-described eleventh embodiment (FIG. 11) is that successive sheet S2 is not fed by means of an intermittent feeding operation, but is fed at a prescribed feeding speed V2 whereby successive sheet S2 slidingly contacts former sheet S1 at a point in time when elapsed period tn exceeds set period T. The other points remain unchanged.

That is, the characteristic of this embodiment is that steps ST7E and ST9E in the flowchart shown in FIG. 11 are replaced by steps ST7F and ST9F shown in FIG. 12.

In this embodiment, firstly in step ST7F, the feeding speed V2 (mm/s) is calculated using the following equation:

$$V2=M2/(T-tn)$$

here, M2 is the distance from feeding roller 13 to head 50, a constant value.

After that, in step ST7E1, after the timer which counted tn is reset, the sheet is fed at the above-mentioned speed V2 in step ST9F.

According to this embodiment, when the successive sheet is fed , if elapsed period tn has not reached set period T, successive sheet S2 is ejected at a prescribed feeding speed V2 whereby successive sheet S2 slidingly contacts former sheet S1 at a point in time when elapsed period tn exceeds set period T.

That is, as successive sheet S2 is ejected at a prescribed feeding speed V2, there is even less fear of the user feeling uncomfortable.

Moreover, the other functional effects are the same as those of the eleventh embodiment described above.

Embodiment 13

FIG. 13 is a flow chart showing a thirteenth embodiment of the ink jet recording method related to the present invention. In this drawing, the steps which are the same as those in the flowchart shown in FIG. 8 are given the same step numbers. Moreover, this ninth embodiment partially corresponds to the invention described in claim 5.

The characteristic of this thirteenth embodiment is that at the point in time when a prescribed amount of successive sheet S2 is fed, elapsed period tn and set period T are compared and if elapsed period tn has not yet reached set period T, successive sheet S2 is printed at a line by line feeding speed whereby successive sheet S2 slidingly contacts former sheet S1 at a point in time when elapsed period tn exceeds set period T. Next, the flowchart in FIG. 13 is explained below.

(1) Steps ST1 to ST18 are the same as those shown in FIG. 8.

(2) In step ST19G, it is determined whether or not the sheet has been fed by a prescribed amount. This determination can be carried out in the same way as described in step ST19C1 in FIG. 7.

(3) In step ST19G, if it is determined that the sheet has not been fed by a prescribed amount, whether or not there is any printing data is determined in step ST20G, if there is printing data the process returns to step ST15; if there is no printing data, line by line feeding (the space of one line between a successive line to be printed normally) is repeated until the prescribed amount has been fed.

(4) In step ST19G, if it is determined that the prescribed amount of the sheet has been fed, it is determined whether or not elapsed period tn has reached set period T (tn>T) in step ST21G.

If the condition is tn>T, the tn timerb is reset in step ST25G, and after an elapsed period t (n+1) is set for the next sheet in step ST26G, the sheet is ejected in step ST27G and the process returns to the start.

If the condition is not tn>T, whether or not there is any printing data is determined in step ST22G.

(5) In step ST22G, if it is determined that there is printing data, firstly a waiting period T3 is calculated in step ST23G using the following equation:

$$T3=(T-tn)/N3-0.1.$$

Here, N3 is the number of lines of printing data, 0.1 (sec.) is time necessary for the line feeding.

Next, in step ST24G, after carrying out printing of lines N3 by line by line feeding at intermittent period T3, the process proceeds with the above described step ST25G onward.

(6) In step ST22G, if it is determined that there is no printing data, after an elapsed period t (n+1) is set for the next sheet in step ST26G, the process proceeds with step ST26 onward, explained in FIG. 3.

According to the above kind of embodiment, at the point in time when a prescribed amount of successive sheet S2 is fed, elapsed period tn and set period T are compared and if elapsed period tn has not yet reached set period T, successive sheet S2 is printed at a line by line feeding speed whereby successive sheet S2 slidingly contacts former sheet S1 at a point in time when elapsed period tn exceeds set period T.

Consequently, as successive sheet S2 slidingly contacts former sheet S1 at a point in time when ink printed on former sheet S1 is fixed enough that it does not adhere to successive sheet S2 stacked on top of former sheet S1, there is no smudging of the printed surface of the already ejected sheet S1.

And so, as successive sheet S2 is printed at a prescribed line feeding speed, the user does not suffer from an uncomfortable feeling.

That is, according to this ink jet recording method, smudging of the printed surface of already ejected sheets can be prevented without causing a feeling of uneasiness in the user in an ink jet recording method of the type wherein already printed sheets are ejected stacked one on top of the other.

Moreover, in this embodiment, feeding speed of a prescribed line amount was realized by means of setting an appropriate waiting period T3, but it is also possible to realize it by means of setting appropriately the feeding speed for one line of the sheet itself.

Embodiment 14

In this fourteenth embodiment, in contrast to the point in the thirteenth embodiment whereby the elapsed period was measured from the point in time when printing of the former sheet was completed, the elapsed period tn is measured from the point in time when the trailing edge of the former sheet is detected.

This fourteenth embodiment can be realized by inserting steps ST24 and ST25 shown in FIG. 3 before step ST25G, and inserting the same steps ST24 and ST25 shown in FIG. 3 before step ST26 in the thirteenth embodiment (FIG. 13).

According to this fourteenth embodiment, as the measurement of elapsed period tn is carried out from the moment in time when the trailing edge of the former sheet is detected, it is possible to more reliably prevent smudging of the printed surface of the ejected sheets.

The other functional effects are the same as in the thirteenth embodiment.

Embodiment 15

The characteristic of this embodiment is that in the above described first to fourteenth embodiments, the printing density of former sheet S1 is measured and a set period T is set corresponding to that printing density.

The set period T in the above described first to fourteenth embodiments is set, as earlier described, on the assumption that the printing density is relatively high, but in actuality there are cases where the printing density is low.

Therefore, in the fifteenth embodiment, the printing density of the former sheet S1 is measured and set period T is set corresponding to this printing density. The details of setting this set period T are as follows.

(1) With a fully printed condition (the printing region of the sheet is completely black) as 100%, in a real case, for example, by counting a number of dots D printed by step ST16 in FIG. 3, the printing density can be found by using the following equation:

$$\text{Printing Density } (\%)=(D/D1\times 100)$$

where D1 is the number of dots when full printing is carried out.

(2) The set period is set by applying a factor corresponding to the printing density to the set period shown in FIG. 4.

For example, set period T is set by applying factor a as shown in FIG. 14. The data shown in FIG. 14 is stored, for example, in ROM 84.

According to this fifteenth embodiment, as the printing density of the former sheet S1 is measured and set period T is set corresponding to this printing density, set period T is set appropriately.

In general, if the printing density, that is the volume of ink per unit of area (the number of dots), is low, ink discharged onto a sheet will fix easily, as it will be absorbed into the sheet easily or will dry easily and therefore; if the printing density is high, absorbing into a sheet or drying will be difficult therefore the ink will not fix easily. Consequently, if the printing density is low, the set period T must be short, and if the printing density is high, the set period T must be long.

According to this fifteenth embodiment, because the set period is set appropriately corresponding to the above-mentioned printing density, at the same time as ink printed on the former sheet S1 is fixed to the extent that it will not adhere to a successive sheet S2 stacked on top of the former sheet S1 at the point in time when the successive sheet S2 slidingly contacts the former sheet S1, it is possible to prevent delaying of the successive sheet S2 other than that which is necessary, and effective printing of a plurality of sheets is possible.

Embodiment 16

The point of difference between this sixteenth embodiment and the above mentioned fifteenth embodiment is that the printing density of only the location where successive sheet S2 slidingly contacts former sheet S1 is measured, the other points are the same.

As described previously, the location where successive sheet S2 slidingly contacts former sheet S1 is a constant range (for example, region A in FIG. 9), depending on the type of recording apparatus and sheet (stiffness etc.).

According to this sixteenth embodiment, because the measurement of the printing density of the former sheet is carried out at the location of sliding contact with the successive sheet, it is possible to set the set period even more appropriately.

Embodiment 17

The characteristic of this embodiment is that in the above described first to sixteenth embodiments, the length of former sheet S1 is measured, and said set period T is set corresponding to that length.

Measurement of the the sheet length can be carried out by such a method as counting the number of rotations of sheet feeding roller 40 (the number of steps of SF motor 41) between detection of "on" and "off" of sheet detection means 30 in the processes from step ST8 to step ST12 in FIG. 3, and it is possible to set the set period by applying a corresponding factor to a set period such as those shown in FIG. 4.

Generally speaking, if the sheet is long, the period until the successive sheet makes sliding contact with the former sheet is long; if the sheet is short, the period until the successive sheet makes sliding contact with the former sheet is short. Consequently, if the sheet is long, the set period must be short, and if the sheet is short, the set period must be long.

According to this seventeenth embodiment, because the set period corresponding to the length of the above-mentioned sheet is set appropriately, at the same time as ink printed on the former sheet is fixed to the extent that it will not adhere to a successive sheet stacked on top of the former sheet at the point in time when the successive sheet slidingly contacts the former sheet, it is possible to prevent delaying of the successive sheet other than that which is necessary, and effective printing of a plurality of sheets is possible.

Embodiment 18

The characteristic of this embodiment is that in the above described first to seventeenth embodiments, the set period is set corresponding to the material of former sheet S1.

For example, in the flowchart shown in FIG. 3, identification of the type of sheet is carried out prior to step ST6 (for example, between steps ST4 and ST6); and set period T is set in step ST6 corresponding to the type of sheet (including the sheet material). It is possible to set the set period by applying a factor corresponding to the type of sheet to a set period such as those shown in FIG. 4.

Generally speaking, if the sheet material is such that ink discharged onto the sheet is easily absorbed, the ink will be fixed easily on the sheet; if the sheet material is such that ink discharged onto the sheet is difficult to absorb, it will be difficult for the ink to be fixed. Consequently, if the sheet material is such that ink discharged onto the sheet is easily absorbed, the set period must be short, and if the sheet material is such that ink discharged onto the sheet is difficult to absorb, the set period must be long.

According to this eighteenth embodiment, because the set period corresponding to the material of the above-mentioned sheet is set appropriately, at the same time as ink printed on the former sheet is fixed to the extent that it will not adhere to a successive sheet stacked on top of the former sheet at the point in time when the successive sheet slidingly contacts the former sheet, it is possible to prevent delaying of the successive sheet other than that which is necessary, and it is possible to print of a plurality of sheets effectively.

The preceding is an explanation of the embodiments of this invention, but the invention is not limited to the embodiments described above: many other suitable variations are possible within the scope of the invention.

What is claimed is:

1. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

measuring an elapsed period from a point in time when printing on said former sheet is completed;

comparing said elapsed period with said set period when said successive sheet is ejected; and if said elapsed period has not reached said set period, ejecting said successive sheet by an intermittent feeding operation in which said successive sheet slidingly contacts said former sheet due to the ejection operation of said successive sheet at a point in time when said elapsed period exceeds said set period.

2. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

measuring an elapsed period from a point in time when printing on said. former sheet is completed;

comparing said elapsed period with said set period when said successive sheet is ejected; and if said elapsed period has not reached said set period, ejecting said successive sheet at a prescribed ejection speed whereby said successive sheet slidingly contacts said former sheet due to the ejection operation of said successive sheet at a point in time when said elapsed period exceeds said set period.

3. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

detecting a trailing edge of said former sheet;

measuring an elapsed period from a point in time when said trailing edge of said former sheet is detected;

comparing said elapsed period with said set period when said successive sheet is ejected; and if said elapsed period has not reached said set period, ejecting said successive sheet by an intermittent feeding operation in which said successive sheet slidingly contacts said former sheet due to the ejection operation of said successive sheet at a point in time when said elapsed period exceeds said set period.

4. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

detecting a trailing edge of said former sheet;

measuring an elapsed period from a point in time when said trailing edge of said former sheet is detected;

comparing said elapsed period with said set period when said successive sheet is ejected; and if said elapsed period has not reached said set period, ejecting said successive sheet at a prescribed ejection speed whereby said successive sheet slidingly contacts, said former sheet due to the ejection operation of said successive sheet at a point in time when said elapsed period exceeds said set period.

5. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

measuring an elapsed period from a point in time when printing on said former sheet is completed;

comparing said elapsed period with said set period at a point in time when a prescribed amount of said successive sheet has been fed; and if said elapsed period has not reached said set period, ejecting said successive sheet at a feeding speed of a prescribed number of lines whereby said successive sheet slidingly contacts said former sheet at a point in time when said elapsed period exceeds said set period.

6. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

detecting a trailing edge of said former sheet;

measuring an elapsed period from a point in time when said trailing edge of said former sheet is detected;

comparing said elapsed period with said set period at a point in time when a prescribed amount of said successive sheet has been fed; and if said elapsed period has not reached said set period, printing said successive sheet at a feeding speed of a prescribed number of lines whereby said successive sheet slidingly contacts said former sheet at a point in time when said elapsed period exceeds said set period.

7. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

measuring an elapsed period from a point in time when printing on said former sheet is completed;

comparing said elapsed period with said set period at a point in time when a prescribed amount of said successive sheet has been fed; and if said elapsed period has not reached said set period, ejecting said successive sheet after the printing operation is completed by an intermittent feeding operation in which said successive sheet slidingly contacts said former sheet at a point in time when said elapsed period exceeds said set period.

8. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

measuring an elapsed period from a point in time when printing on said former sheet is completed;

comparing said elapsed period with said set period at a point in time when a prescribed amount of said successive sheet has been fed; and if said elapsed period has not reached said set period, ejecting said successive sheet after the printing operation is completed at a prescribed ejection speed whereby said successive sheet slidingly contacts said former sheet at a point in time when said elapsed period exceeds said set period.

9. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

detecting a trailing edge of said former sheet;

measuring an elapsed period from a point in time when said trailing edge of said former sheet is detected;

comparing said elapsed period with said set period at a point in time when a prescribed amount of said successive sheet has been fed; and if said elapsed period has not reached said set period, ejecting said successive sheet after the printing operation is completed by an intermittent feeding operation in which said successive sheet slidingly contacts said former sheet at a point in time when said elapsed period exceeds said set period.

10. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

detecting a trailing edge of said former sheet;

measuring an elapsed period from a point in time when said trailing edge of said former sheet is detected;

comparing said elapsed period with said set period at a point in time when a prescribed amount of said successive sheet has been fed; and if said elapsed period has not reached said set period, ejecting said successive sheet after the printing operation is completed at a prescribed ejection speed whereby said successive sheet slidingly contacts said former sheet at a point in time when said elapsed period exceeds said set period.

11. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

measuring an elapsed period from a point in time when printing up to the region of said former sheet where said former sheet slidingly contacts said successive sheet completed;

comparing said elapsed period with said set period when said successive sheet is ejected; and if said elapsed period has not reached said set period, ejecting said successive sheet by an intermittent feeding operation in which said successive sheet slidingly contacts said former sheet due to the ejection operation of said successive sheet at a point in time when said elapsed period exceeds said set period.

12. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

measuring an elapsed period from a point in time when printing up to the region of said former sheet where said former sheet slidingly contacts said successive sheet is completed;

comparing said elapsed period with said set period when said successive sheet is ejected; and if said elapsed period has not reached said set period, ejecting said successive sheet at a prescribed ejection speed whereby said successive sheet slidingly contact, said former sheet due to the ejection operation of said successive sheet at a point in time when said elapsed period exceeds said set period.

13. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

measuring an elapsed period from a point in time when printing up to the region of said former sheet where said former sheet slidingly contacts said successive sheet is completed;

comparing said elapsed period with said set period when said successive sheet is fed; and if said elapsed period has not reached said set period, feeding said successive sheet after a prescribed period has elapsed whereby said successive sheet slidingly contacts said former sheet at a point in time when said elapsed period exceeds said set period.

14. An ink jet recording method wherein multiple sheets are fed one by one towards an ink jet head and are ejected and stacked one on top of another after printing by the ink jet head, comprising the steps of:

setting a set period, wherein said set period is the time necessary for fixing ink printed on a former sheet such that said former sheet does not adhere to a successive sheet stacked on top of said former sheet;

measuring an elapsed period from a point in time when printing up to the region of said former sheet where said former sheet slidingly contacts said successive sheet is completed;

comparing said elapsed period with said set period when said successive sheet is fed; and if said elapsed period has not reached said set period, feeding said successive sheet at a prescribed feeding speed whereby said successive sheet slidingly contacts said former sheet at a point in time when said elapsed period exceeds said set period.

15. The ink jet recording method of any one of claims 1 to 14, wherein:

a temperature in a vicinity of either said ink jet head or said former sheet is measured, and said set period is set corresponding to said temperature.

16. The ink jet recording method of any one of claims 1 to 14, wherein:

a printing density of said former sheet is measured, and said set period is set corresponding to said printing density.

17. The ink jet recording method of claim 16, wherein:

the measurement of the printing density of said former sheet is the measurement of the printing density of a region in sliding contact with said successive sheet.

18. The ink jet recording method of any one of claims 1 to 14, wherein:

a length of said former sheet is measured, and said set period is set corresponding to said length.

19. The ink jet recording method of any one of claims 1 to 14, wherein:

said set period is set corresponding to a material of said former sheet.

20. The ink jet recording method of any one of claims 1 to 14, wherein:

said set period is set corresponding to a type of ink discharged from said ink jet head.

21. The ink jet recording method of claims 2, 4, 8, 10 or 12, wherein said prescribed ejection speed is a function of the distance from said former sheet to an ejection location, and a difference between said set period and said elapsed period.

22. The ink jet recording method of claim 14 wherein said prescribed feeding speed is a function of the distance from said former sheet to an ejection location, and a difference between said set period and said elapsed period.

23. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

measuring an elapsed period from a point in time when printing on said former sheet is completed;

comparing said elapsed period with said set period when said successive sheet is ejected; and if said elapsed period has not reached said set period, ejecting said successive sheet by an intermittent feeding operation in which said successive sheet slidingly contacts said former sheet due to the ejection operation of said successive sheet at a point in time when said elapsed period exceeds said set period.

24. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

measuring an elapsed period from a point in time when printing on said former sheet is completed;

comparing said elapsed period with said set period when said successive sheet is ejected; and if said elapsed period has not reached said set period, ejecting said successive sheet at a prescribed ejection speed whereby said successive sheet slidingly contacts said former sheet due to the ejection operation of said successive sheet at a point in time when said elapsed period exceeds said set period.

25. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

detecting a trailing edge of said former sheet;

measuring an elapsed period from a point in time when said trailing edge of said former sheet is detected;

comparing said elapsed period with said set period when said successive sheet is ejected; and if said elapsed period has not reached said set period, ejecting said successive sheet by an intermittent feeding operation in which said successive sheet slidingly contacts said former sheet due to the ejection operation of said successive sheet at a point in time when said elapsed period exceeds said set period.

26. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

detecting a trailing edge of said former sheet;

measuring an elapsed period from a point in time when said trailing edge of said former sheet is detected;

comparing said elapsed period with said set period when said successive sheet is ejected; and if said elapsed period has not reached said set period, ejecting said successive sheet at a prescribed ejection speed whereby said successive sheet slidingly contacts said former sheet due to the ejection operation of said successive sheet at a point in time when said elapsed period exceeds said set period.

27. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

measuring an elapsed period from a point in time when printing on said former sheet is completed;

comparing said elapsed period with said set period at a point in time when a prescribed amount of said successive sheet has been fed; and if said elapsed period has not reached said set period, ejecting said successive sheet at a feeding speed of a prescribed number of lines whereby said successive sheet slidingly contacts said former sheet at a point in time when said elapsed period exceeds said set period.

28. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

detecting a trailing edge of said former sheet;

measuring an elapsed period from a point in time when said trailing edge of said former sheet is detected;

comparing said elapsed period with said set period at a point in time when a prescribed amount of said successive sheet has been fed; and if said elapsed period has not reached said set period, printing said successive sheet at a feeding speed of a prescribed number of lines whereby said successive sheet slidingly contacts said former sheet at a point in time when said elapsed period exceeds said set period.

29. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

measuring an elapsed period from a point in time when printing on said former sheet is completed;

comparing said elapsed period with said set period at a point in time when a prescribed amount of said successive sheet has been fed; and if said elapsed period has not reached said set period, ejecting said successive sheet after the printing operation is completed by an intermittent feeding operation in which said successive sheet slidingly contacts said former sheet at a point in time when said elapsed period exceeds said set period.

30. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

measuring an elapsed period from a point in time when printing on said former sheet is completed;

comparing said elapsed period with said set period at a point in time when a prescribed amount of said successive sheet has been fed; and if said elapsed period has not reached said set period, ejecting said successive sheet after the printing operation is completed at a prescribed ejection speed whereby said successive sheet slidingly contacts said former sheet at a point in time when said elapsed period exceeds said set period.

31. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

detecting a trailing edge of said former sheet;

measuring an elapsed period from a point in time when said trailing edge of said former sheet is detected;

comparing said elapsed period with said set period at a point in time when a prescribed amount of said successive sheet has been fed; and if said elapsed period has not reached said set period, ejecting said successive sheet after the printing operation is completed by an intermittent feeding operation in which said successive sheet slidingly contacts said former sheet at a point in time when said elapsed period exceeds said set period.

32. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

detecting a trailing edge of said former sheet;

measuring an elapsed period from a point in time when said trailing edge of said former sheet is detected;

comparing said elapsed period with said set period at a point in time when a prescribed amount of said successive sheet has been fed; and if said elapsed period has not reached said set period, ejecting said successive sheet after the printing operation is completed at a prescribed ejection speed whereby said successive sheet slidingly contacts said former sheet at a point in time when said elapsed period exceeds said set period.

33. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

measuring an elapsed period from a point in time when printing up to the region of said former sheet where said former sheet slidingly contacts said successive sheet is completed;

comparing said elapsed period with said set period when said successive sheet is ejected; and if said elapsed period has not reached said set period, ejecting said successive sheet by an intermittent feeding operation in which said successive sheet slidingly contacts said former sheet due to the ejection operation of said successive sheet at a point in time when said elapsed period exceeds said set period.

34. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

measuring an elapsed period from a point in time when printing up to the region of said former sheet where said former sheet slidingly contacts said successive sheet is completed;

comparing said elapsed period with said set period when said successive sheet is ejected; and if said elapsed period has not reached said set period, ejecting said successive sheet at a prescribed ejection speed whereby said successive sheet slidingly contacts said former sheet due to the ejection operation of said successive sheet at a point in time when said elapsed period exceeds said set period.

35. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

measuring an elapsed period from a point in time when printing up to the region of said former sheet where said former sheet slidingly contacts said successive sheet is completed;

comparing said elapsed period with said set period when said successive sheet is fed; and if said elapsed period has not reached said set period, feeding said successive sheet after a prescribed period has elapsed whereby said successive sheet slidingly contacts said former sheet at a point in time when said elapsed period exceeds said set period.

36. An ink jet recording method wherein multiple sheets are fed one by one towards an ink jet head and are ejected and stacked one on top of another after printing by the ink jet head, comprising the steps of:

measuring a temperature in a vicinity of either said ink jet head or a former sheet;

setting a set period, wherein said set period is the time necessary for fixing ink printed on said former sheet such that said former sheet does not adhere to a successive sheet stacked on top of said former sheet, said set period being a function of said temperature;

measuring an elapsed period from a point in time when printing up to the region of said former sheet where said former sheet slidingly contacts said successive sheet is completed;

comparing said elapsed period with said set period when said successive sheet is fed; and if said elapsed period has not reached said set period, feeding said successive sheet at a prescribed feeding speed whereby said successive sheet slidingly contacts said former sheet at a point in time when said elapsed period exceeds said set period.

* * * * *